US010585382B2

(12) United States Patent
Kaneda

(10) Patent No.: US 10,585,382 B2
(45) Date of Patent: Mar. 10, 2020

(54) PRINTING APPARATUS, METHOD FOR CONTROLLING THE SAME, AND STORAGE MEDIUM

(71) Applicant: CANON KABUSHIKI KAISHA, Tokyo (JP)

(72) Inventor: Takeshi Kaneda, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/239,074

(22) Filed: Jan. 3, 2019

(65) Prior Publication Data

US 2019/0137921 A1 May 9, 2019

Related U.S. Application Data

(63) Continuation of application No. PCT/JP2017/024304, filed on Jul. 3, 2017.

(30) Foreign Application Priority Data

Jul. 8, 2016 (JP) ..... 2016-136106

(51) Int. Cl.
*G03G 15/00* (2006.01)
*G03G 21/00* (2006.01)

(52) U.S. Cl.
CPC ..... *G03G 15/5062* (2013.01); *G03G 15/5087* (2013.01); *G03G 15/6538* (2013.01); *G03G 15/6582* (2013.01); *G03G 21/00* (2013.01); *G03G 2215/00818* (2013.01); *G03G 2215/00827* (2013.01)

(58) Field of Classification Search
CPC ..... G03G 15/5062; G03G 15/5087; G03G 15/6538; G03G 15/6541; G03G 15/6582; G03G 2215/00818; G03G 2215/00827
See application file for complete search history.

(56) References Cited

U.S. PATENT DOCUMENTS 5,881,352 A * 3/1999 Kobayashi ..... G03G 15/6541 270/37
5,930,001 A * 7/1999 Satoh ..... G03G 15/5025 358/296
2007/0195335 A1 8/2007 Tanaka
2013/0250344 A1 9/2013 Merriam et al.

FOREIGN PATENT DOCUMENTS

JP 06-064366 A 3/1994
JP 2007-280369 A 10/2007
JP 2012-105181 A 5/2012
JP 2013-187571 A 9/2013
JP 2015-206903 A 11/2015

* cited by examiner

*Primary Examiner* — Sandra Brase
(74) *Attorney, Agent, or Firm* — Canon U.S.A., Inc. IP Division

(57) ABSTRACT

An MFP receives print data from an information processing apparatus, such as a mobile terminal or a PC. It is determined whether a predetermined character code is included as content in the received print data. A setting is changed so that the post-processing is performed in a position based on a right end of a printed matter in accordance with the determination before the printed matter is output.

13 Claims, 18 Drawing Sheets

FIG. 4

CONTENT OF RESPONSE
FROM MFP 101 (EXTRACT)

...

3: none
4: staple
20: staple-top-left
21: staple-bottom-left
22: staple-top-right
23: staple-bottom-right
28: staple-dual-left
29: staple-dual-top
30: staple-dual-right
31: staple-dual-bottom

...

5: punch
74: punch-dual-left
75: punch-dual-top
76: punch-dual-right
77: punch-dual-bottom

...

10: fold
101: fold-engneering-z
102: fold-engneering-z-top
103: fold-engneering-z-bottom

...

FIG. 5A

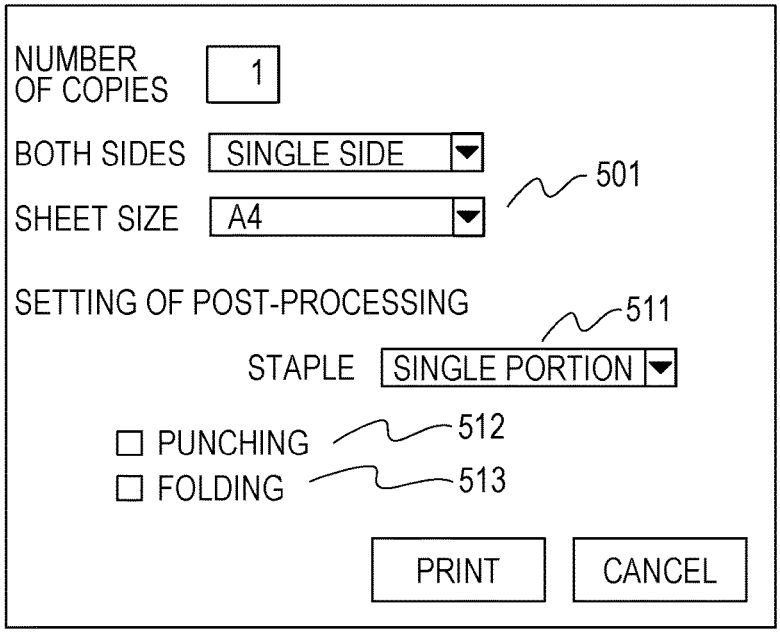

FIG. 5B

FIRST EXAMPLE OF PRINT SETTING
SHEET SIZE: A4(210×297 mm)
DIRECTION: PORTRAIT
STAPLING: SINGLE PORTION

↓
FIRST EXAMPLE OF PRINT DATA
JOB NAME = "XXXXX"
FILE NAME = ""YYYYYY"
PAPER SIZE = A4
...
FINISHINGS =
20: staple-top-left SECOND EXAMPLE OF PRINT SETTING
SHEET SIZE: A4(210×297 mm)
DIRECTION: PORTRAIT
PUNCHING: ON ↓
SECOND EXAMPLE OF PRINT DATA
JOB NAME = "XXXXX"
FILE NAME = ""YYYYYY"
PAPER SIZE = A4
...
FINISHINGS =
74: punch-dual-left THIRD EXAMPLE OF PRINT SETTING
SHEET SIZE: A4(210×297 mm)
DIRECTION: LANDSCAPE
FOLDING: ON ↓
THIRD EXAMPLE OF PRINT DATA
JOB NAME = "XXXXX"
FILE NAME = ""YYYYYY"
PAPER SIZE = A4
...
FINISHINGS =
101: fold-engneering-z

FIG. 10A

| | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 059 | □ | ◌ | ◌ | ◌ | ◌ | ◌ | ◌ | ◌ | ◌ | ◌ | ◌ | ◌ | ◌ | ◌ | ◌ | ◌ |
| 05A | ◌ | ◌ | ◌ | ◌ | ◌ | ◌ | ◌ | ◌ | ◌ | ◌ | ◌ | ◌ | ◌ | ◌ | ◌ | ◌ |
| 05B | ◌ | ◌ | ◌ | ◌ | ◌ | ◌ | ◌ | ◌ | ◌ | · | · | ◌ | ◌ | ◌ | – | ◌ |
| 05C | ו | ◌ | ◌ | : | ◌ | ◌ | ع | ◌ | □ | □ | □ | □ | □ | □ | □ | □ |
| 05D | א | ב | ג | ד | ה | ו | ז | ח | ט | י | ך | כ | ל | ם | מ | ן |
| 05E | נ | ס | ע | ף | פ | ץ | צ | ק | ר | ש | ת | □ | □ | □ | □ | □ |
| 05F | ״ | ״ | ״ | ′ | ″ | □ | □ | □ | □ | □ | □ | □ | □ | □ | □ | □ |

FIG. 10B

| | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 060 | ـ | ـ | ـ | ـ | □ | □ | □ | □ | □ | □ | □ | ، | ، | ، | ـ | ع |
| 061 | ◌ | ◌ | ◌ | ◌ | ◌ | ◌ | □ | □ | □ | □ | □ | ؛ | □ | □ | ؛ | ؟ |
| 062 | □ | ء | آ | أ | ؤ | إ | ئ | ا | ب | ة | ت | ث | ج | ح | خ | د |
| 063 | ذ | ر | ز | س | ش | ص | ض | ط | ظ | ع | غ | □ | □ | □ | □ | □ |
| 064 | ـ | ف | ق | ك | ل | م | ن | ه | و | ى | ي | ◌ | ◌ | ◌ | ◌ | ◌ |
| 065 | ◌ | ◌ | ◌ | ◌ | ◌ | ◌ | ◌ | ◌ | ◌ | ◌ | ◌ | ◌ | ◌ | ◌ | ◌ | □ |
| 066 | ٠ | ١ | ٢ | ٣ | ٤ | ٥ | ٦ | ٧ | ٨ | ٩ | ٪ | ، | ، | * | ـ | ق |
| 067 | ◌ | ◌ | ◌ | ◌ | ◌ | ◌ | ◌ | ◌ | ◌ | ◌ | ◌ | ◌ | ◌ | ◌ | ◌ | ◌ |
| 068 | ◌ | ◌ | ◌ | ◌ | ◌ | ◌ | ◌ | ◌ | ◌ | ◌ | ◌ | ◌ | ◌ | ◌ | ◌ | ◌ |
| 069 | ◌ | ◌ | ◌ | ◌ | ◌ | ◌ | ◌ | ◌ | ◌ | ◌ | ◌ | ◌ | ◌ | ◌ | ◌ | ◌ |
| 06A | ◌ | ◌ | ◌ | ◌ | ◌ | ◌ | ◌ | ◌ | ◌ | ◌ | ◌ | ◌ | ◌ | ◌ | ◌ | ◌ |
| 06B | ◌ | ◌ | ◌ | ◌ | ◌ | ◌ | ◌ | ◌ | ◌ | ◌ | ◌ | ◌ | ◌ | ◌ | ◌ | ◌ |
| 06C | ◌ | ◌ | ◌ | ◌ | ◌ | ◌ | ◌ | ◌ | ◌ | ◌ | ◌ | ◌ | ◌ | ◌ | ◌ | ◌ |
| 06D | ◌ | ◌ | ◌ | ◌ | ◌ | ◌ | ◌ | ◌ | ◌ | ◌ | ◌ | ◌ | ◌ | ◌ | ◌ | ◌ |
| 06E | ◌ | ◌ | ◌ | ◌ | ◌ | ◌ | ◌ | ◌ | ◌ | ◌ | ◌ | ◌ | ◌ | ◌ | ◌ | ◌ |
| 06F | ٠ | ١ | ٢ | ٣ | ٤ | ٥ | ٦ | ٧ | ٨ | ٩ | ◌ | ◌ | ◌ | ◌ | ◌ | ◌ |

PRINTING APPARATUS, METHOD FOR CONTROLLING THE SAME, AND STORAGE MEDIUM

CROSS-REFERENCE TO RELATED APPLICATIONS

This application is a Continuation of International Patent Application No. PCT/JP2017/024304, filed Jul. 3, 2017, which claims the benefit of Japanese Patent Application No. 2016-136106 filed Jul. 8, 2016, both of which are hereby incorporated by reference herein in their entirety.

TECHNICAL FIELD

The present disclosure relates to a printing apparatus which receives and processes print data.

BACKGROUND ART

In general, a printing apparatus which is connected to a network and which is capable of receiving print data from an information processing apparatus through the network and printing the print data has been used. Furthermore, generation of print data to be transmitted to a printing apparatus using printer drivers (or print applications) designed for use of respective print apparatuses has been performed.

Moreover, in recent years, generation of print data without using printer drivers (or print applications) designed for use of respective print apparatuses has been used (refer to PTL 1, for example). For example, in general, print data is generated by a general print service provided as a function of an operating system (OS) of an information processing apparatus or a general print service provided by a print server or the like on a cloud and the generated print data is transmitted to a printing apparatus. In such a general print service, a network protocol for causing the printing apparatus to execute printing is implemented, and printing is realized by communicating with the printing apparatus in accordance with the protocol.

Furthermore, such a print server and such an information processing apparatus which provide general print services preferably support various types of printing apparatus. Here, the general print service manages configuration information of the printing apparatus so as to support different functions and different specifications of different printing apparatuses.

Furthermore, a printing apparatus performs post-processing on sheets, such as a binding process or a punching process, specified by a user.

CITATION LIST

Patent Literature

PTL 1 Japanese Patent Laid-Open No. 2013-187571

SUMMARY OF INVENTION

According to an embodiment of the present disclosure, a printing apparatus includes a reception unit configured to receive print data supplied from an external apparatus, a printing unit configured to perform printing on sheets based on the print data received by the reception unit, a post-processing controller configured to control a post-processing apparatus connected to the printing apparatus and execute post-processing on the sheets printed by the printing unit, and a controller configured to control at least one of the printing unit and the post-processing controller so that the post-processing is executed on a right end of the sheets printed based on the print data in a case where a predetermined character code is included in the print data and an instruction for executing the post-processing on a left end of the sheets printed based on the print data is included in the print data, and control at least one of the printing unit and the post-processing controller so that the post-processing is executed based on a position of the post-processing set in the print data when the predetermined character code is not included in the print data but an instruction for executing the post-processing on the print data is included in the print data.

Further features of the present invention will become apparent from the following description of exemplary embodiments with reference to the attached drawings.

BRIEF DESCRIPTION OF DRAWINGS

FIG. 4 is a diagram illustrating an example of configuration information to be transmitted from the MFP to the information processing apparatus.

FIGS. 5A and 5B are diagrams illustrating print settings and print data.

FIGS. 10A and 10B are diagrams illustrating the relationships between byte representation of character codes and corresponding characters.

DESCRIPTION OF EMBODIMENTS

Hereinafter, embodiments of the present disclosure will be described with reference to the accompanying drawings. Note that the embodiments below do not limit the present disclosure according to claims, and it is not necessarily the case that all combinations of features described in the embodiments are required for solving the problems.

Problem to be Solved by the Present Invention

Print data is generated based on a configuration information of a printing apparatus using a general print service. However, print settings are performed on various printing apparatuses through a common setting screen in the general print service, and therefore, a print setting desired by a user may not be obtained.

For example, in general print services, print data corresponding to a left-opening printed matter may be generated. In these general print services, it is determined that content to be printed is horizontally written from left to right which is a writing direction used for languages in Western countries, and print data is generated such that left opening which is an output method suitable for horizontal writing from left to right is attained. Here, the writing direction indicates a direction in which characters are to be written. Furthermore, the horizontal writing from left to right indicates a writing direction in which characters are horizontally written from left to right in a first line and a second line is started from left after a character string has reached an end of the first line.

However, if all printed matters are finished as the left opening, some of users may not desire such a printed matter. For example, a user may desire a printed matter of right opening. Documents in Arabic or Hebraic are horizontally written from right in a writing direction. The horizontal writing from right to left indicates a writing direction in which every time an end of a character string is reached in a certain line, characters are written from right in a next line beneath the certain line. In this way, if a document horizontally written from right to left is to be printed, a printed matter which is not desired by the user may be output unless a right-opening output method suitable for the horizontal writing from right to left is employed.

The present disclosure is made in view of at least one of the problems described above and is provided to perform post-processing on a printed matter so as to realize a more suitable format based on a character code in print data.

First Embodiment

Figure 1:
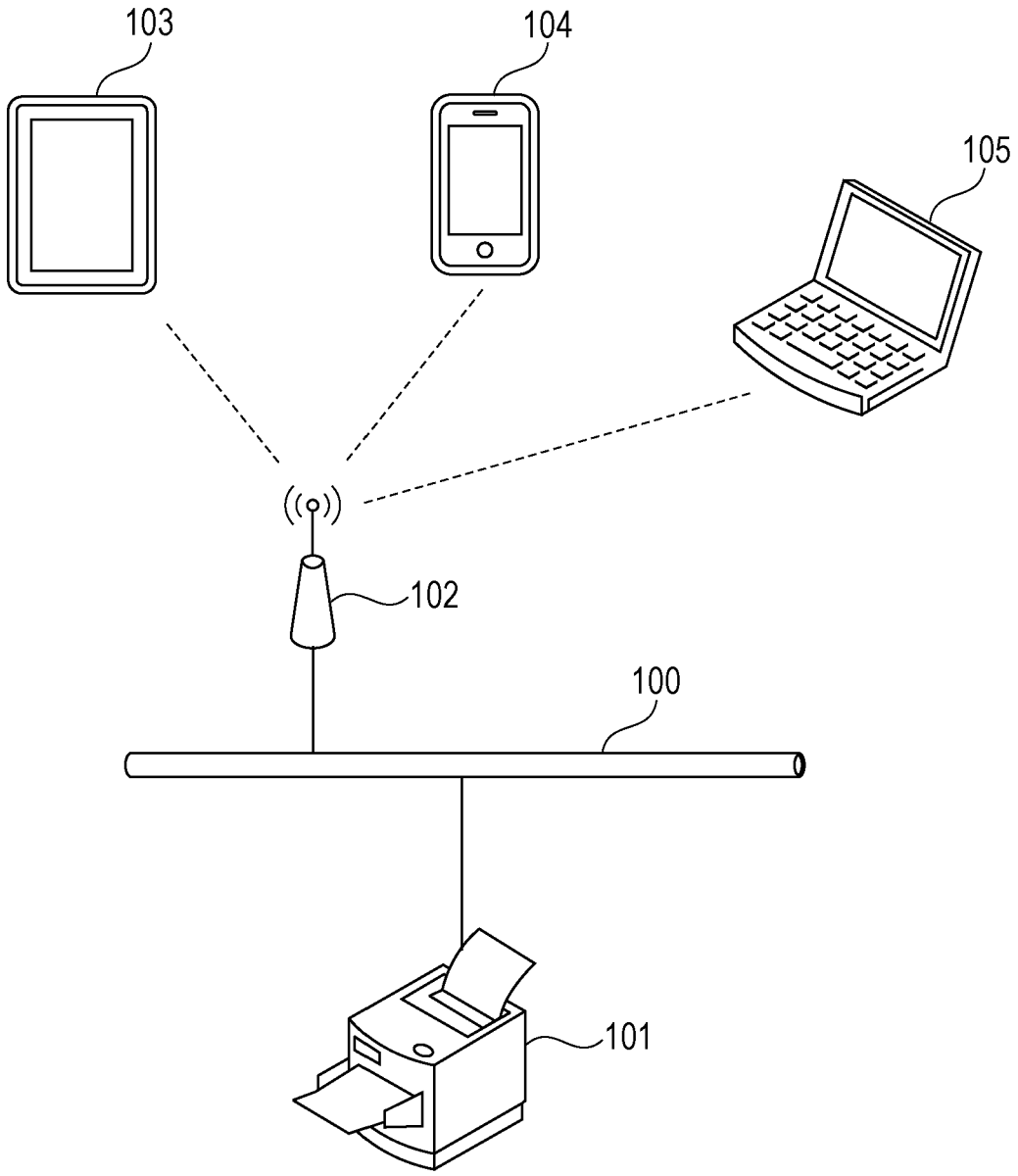
FIG. 1 is a diagram illustrating a configuration of a print system according to a first embodiment of the present disclosure.

FIG. 1 is a block diagram illustrating a print system according to a first embodiment. A multifunction peripheral (MFP) 101 and an access point (AP) 102 are connected to each other in a communication available manner in a local area network (LAN) 100. In this embodiment, the MFP 101 is an example of a printing apparatus. Furthermore, mobile terminals 103 and 104 and a personal computer (PC) 105 are examples of an information processing apparatus. An information processing apparatus, such as the mobile terminals 103 and 104 and the PC 105, may communicate with the MFP 101 in the LAN 100 through the AP 102. Note that the PC 105 may be connected with the LAN 100 through a LAN cable in a wired manner. Although the configuration above is described as an example of the print system in this embodiment, the present disclosure is not limited to this. At least one information processing apparatus and a printing apparatus is connected to each other through a network in a communication available manner.

First, the MFP 101 will be described. The MFP 101 has a reading function of reading an image on a document and a print function of printing an image on a sheet. The MFP 101 may execute a print process based on print data received through the network.

Figure 2:
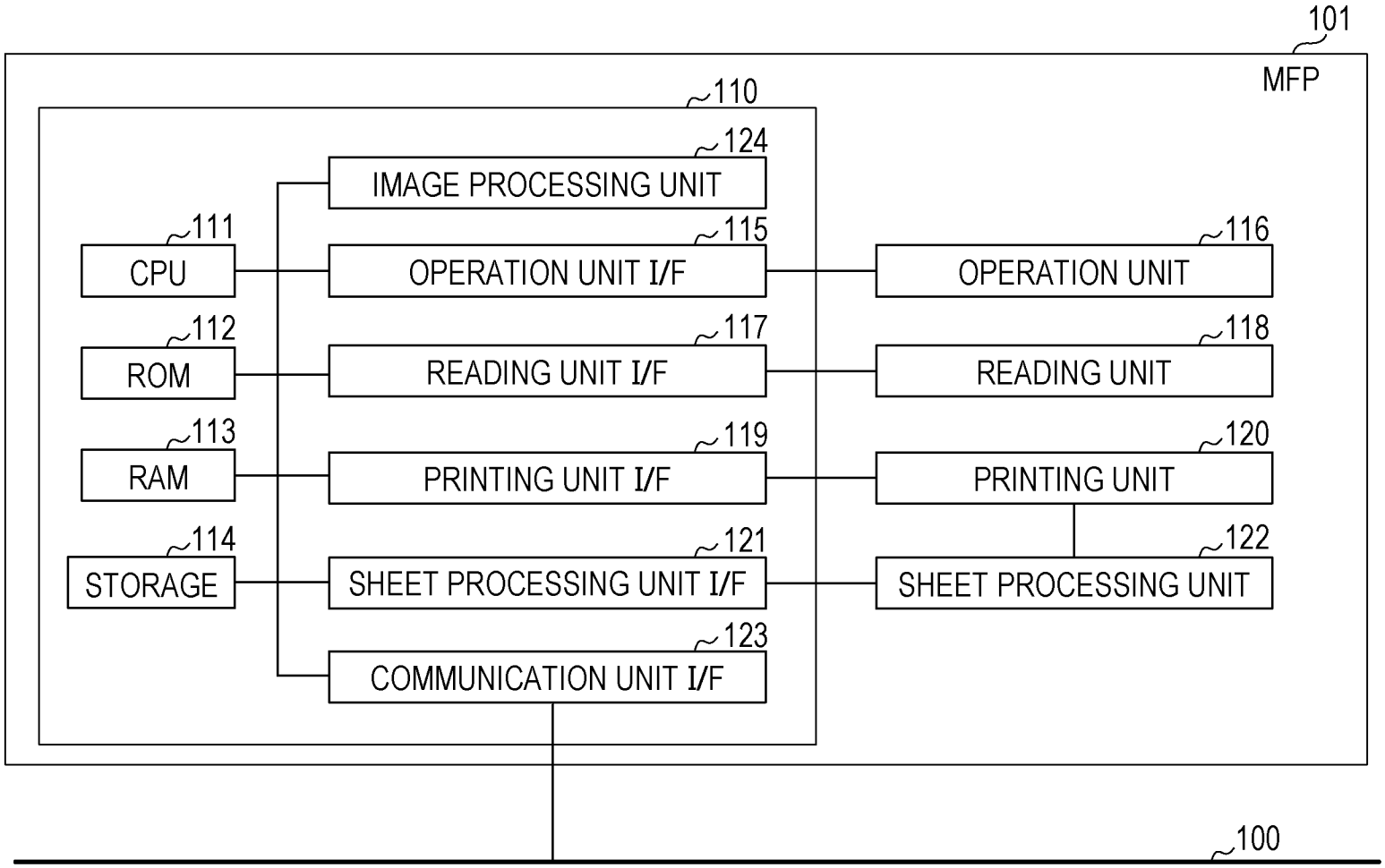
FIG. 2 is a diagram illustrating a hardware configuration of a multifunction peripheral (MFP) according to the first embodiment of the present disclosure.

FIG. 2 is a block diagram illustrating a hardware configuration of the MFP 101. The MFP 101 has the reading function of reading an image on a sheet and the print function of printing an image on a sheet. The MFP 101 further has a file transmission function of transmitting an image to an external information processing apparatus.

Although the MFP 101 is illustrated as an example of the printing apparatus in this embodiment, the present disclosure is not limited to this. For example, the printing apparatus may be a single function peripheral (SFP) which does not have a reading function.

A controller 110 including a central processing unit (CPU) 111 controls operation of the entire MFP 101. The CPU 111 reads control programs stored in a read only memory (ROM) 112 or a storage 114 and performs various control operations including printing control and reading control. The ROM 112 stores control programs which are executable by the CPU 111. A random access memory (RAM) 113 is a main storage memory of the CPU 111 and is used as a work area or a temporary storage region used to develop instructions of the various control programs. The storage 114 stores print data, image data, various programs, and various setting information. Although an auxiliary storage device, such as a hard disk drive (HDD) is assumed as the storage 114 in this embodiment, a nonvolatile memory, such as a solid state drive (SSD) may be used instead of the HDD.

Note that, although the single CPU 111 executes various processes illustrated in flowcharts described below using the single memory (RAM 113) in the MFP 101 of this embodiment, other modes may be employed. For example, various processes illustrated in the flowcharts described below may be executed by operating a plurality of CPUs, a RAM, a ROM, and a storage in cooperation. Furthermore, some of the processes may be executed using a hardware circuit, such as an application specific integrated circuit (ASIC) or a field-programmable gate array (FPGA).

An operation unit interface (I/F) 115 is used to connect an operation unit 116 and the controller 110 to each other. The operation unit 116 includes a liquid crystal display unit having a touch panel function and various hard keys and functions as a display unit which displays information and a reception unit which receives user's instructions.

A reading unit I/F 117 is used to connect a reading unit 118 and the controller 110 to each other. The reading unit 118 reads a document so as to generate a reading image. Note that the generated reading image is stored in the storage 114 or the RAM 113. The reading image generated by the reading unit 118 is transmitted to the information processing apparatus or is used for printing of an image on a sheet.

A printing unit I/F 119 is used to connect a printing unit 120 and the controller 110 to each other. A print image generated by analyzing print data is transmitted from the controller 110 to the printing unit 120 through the printing unit I/F 119. The printing unit 120 receives a control command and a print image through the controller 110 and prints an image on a sheet supplied from a sheet feeding cassette (not illustrated) based on the print image. A printing method of the printing unit 120 may be an electrophotographic method or an inkjet method. Furthermore, other printing methods, such as a thermal transfer method, may be employed.

Furthermore, the controller 110 is connected to the LAN 100 through a communication unit I/F 123. The communication unit I/F 123 transmits an image and information to the information processing apparatus on the LAN 100 and receives print data and information from the information processing apparatus on the LAN 100.

An image processing unit 124 has a function of a raster image processor (RIP) which generates an image to be used for printing by developing the print data received through the network. Furthermore, the image processing unit 124 may perform resolution conversion and a correction process on the image obtained by developing the print data. Note that, although the image processing unit 124 is realized by a hardware circuit (an ASIC, an FPGA, or the like) in this embodiment, the present disclosure is not limited to this. For example, the MFP 101 may further include a processor for image processing which executes an image processing program so as to realize image processing and a print data developing process. In this case, the processor for image processing and the CPU 111 operate in cooperation so as to realize the flowcharts described below. Furthermore, the CPU 111 may execute a program for image processing so as to perform image processing and a print data developing process. Furthermore, image processing may be performed by a combination of any of them.

A sheet processing unit I/F 121 is used to connect the controller 110 and a sheet processing unit 122 to each other. The sheet processing unit 122 receives a control command from the CPU 111 and performs post-processing on sheets printed by the printing unit 120 in accordance with the control command. The post-processing includes aligning of a plurality of sheets, opening of punching holes on sheets, folding processing on a plurality of sheets, and binding of a plurality of sheets. Furthermore, a function and capability of the post-processing of the sheet processing unit 122 are transmitted to the controller 110 through the sheet processing unit I/F 121 and stored in the storage 114 or the RAM 113 in advance (at a time of activation of the MFP 101, for example).

Figure 3:
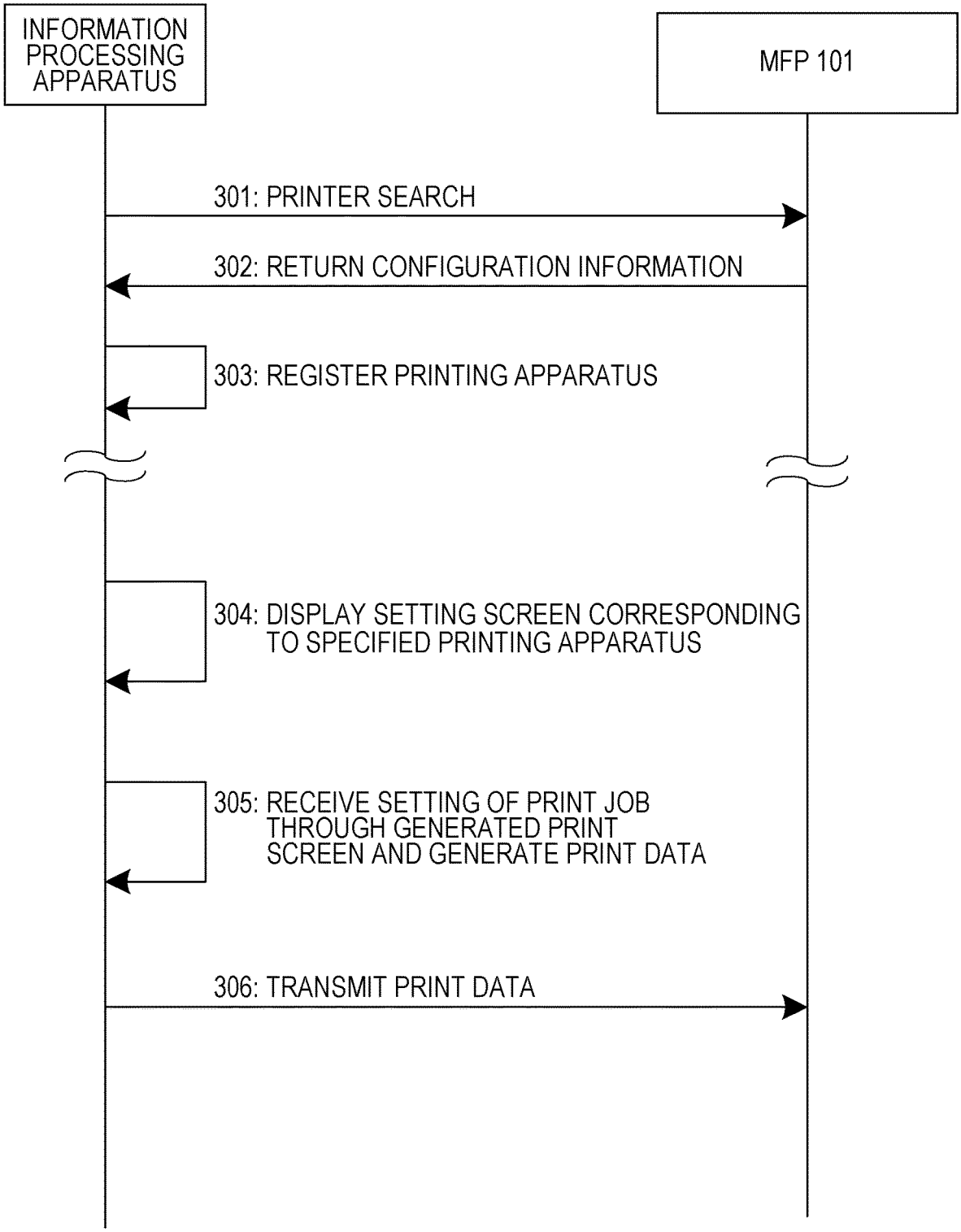
FIG. 3 is a diagram illustrating communication between the MFP and an information processing apparatus according to the first embodiment of the present disclosure.

Next, transmission and reception of information between the information processing apparatus and the MFP 101 will be described with reference to FIG. 3. FIG. 3 is a diagram illustrating a sequence of reception of print data by the MFP 101 from the information processing apparatus. First, the information processing apparatus, such as the mobile terminal 103, the mobile terminal 104, or the PC 105, broadcasts a packet for searching for a printing apparatus on the LAN 100 (301). When receiving the packet for searching for the printing apparatus, the MFP 101 returns configuration information (or capability information) of the MFP 101 to the information processing apparatus which has transmitted the packet (302). The configuration information is described by text data, for example. The text data of the configuration information includes keywords indicating capability of the printing apparatus in advance. As concrete configuration information, compatible sheet sizes, availability of a both-side printing function, availability of N-up function, a type of executable post-processing, and a position of executable post-processing are described as a list of functions supported by the MFP 101. The information processing apparatus may register the capability information of the MFP 101 including the compatible sheet sizes, the availability of both-side printing, the availability of the N-up function, the type of the executable post-processing and so on using the keywords described in the received text data (303). FIG. 4 is a diagram illustrating a portion of the configuration information to be transmitted from the MFP 101 to the information processing apparatus as a response, and the configuration information associated with the post-processing is extracted in this embodiment. The MFP 101 transmits a notification indicating that a printed sheet may be output without performing the post-processing (3: none). Furthermore, the MFP 101 transmits a notification indicating that printed sheets which are stapled may be output and a notification indicating that punching holes may be formed on sheets as text data. Furthermore, the MFP 101 transmits a notification indicating that sheets may be folded before being output as text data. The MFP 101 transmits notifications indicating other detailed settings of the post-processing as text data.

In this embodiment, the sheet processing unit 122 of the MFP 101 may staple one portion at a corner of the printed sheets or two portions on one side of the printed sheets. Accordingly, as information on an executable stapling process, at least 4, 20 to 23, and 28 to 31 in FIG. 4 are transmitted. Furthermore, it is assumed that the sheet processing unit 122 may form two punching holes on one side of the printed sheets. Accordingly, as information on an executable punching process, at least 5 and 74 to 77 in FIG. 4 are transmitted. Furthermore, the sheet processing unit 122 may perform Z-folding by alternately folding the printed sheets by a mountain fold and a valley fold. Accordingly, as information on an executable folding process, at least 10 and 101 to 103 in FIG. 4 are transmitted.

The user may transmit a request for printing to the printing apparatus registered in the registration process (301 to 303 in FIG. 3) in advance. When receiving a designation of the printing apparatus to be used for printing by a user operation, a print service of the information processing apparatus refers to the capability information of the printing apparatus designated by the user. Furthermore, a setting screen for setting print attributes is displayed in a display unit (not illustrated) of the information processing apparatus based on the capability information which has been referenced (304). The user performs an operation on the setting screen using an input unit (not illustrated) so as to set the print attributes. The information processing apparatus generates print data when receiving an instruction for start of printing through the setting screen (305). The information processing apparatus transmits the generated print data to the MFP 101 (306).

Subsequently, the setting of print attributes in the information processing apparatus and the generation of print data described in 305 of FIG. 3 will be described in detail with reference to FIGS. 5A and 5B. FIG. 5A is a diagram illustrating an example of the setting screen for setting print attributes. The user may set a size of sheets to be used for printing by selecting a section 501 of FIG. 5A.

Furthermore, the user may set stapling of printed sheets by selecting a section 511 of FIG. 5A. When the section 511 is selected, a dropdown list, not illustrated, is displayed and the user may select one of "single portion", "two portions", and "none" in the dropdown list. When an item of "single portion" is selected, a corner of the sheets is stapled as the setting. When an item of "two portions" is selected, two portions on one side of the sheets are stapled as the setting. Note that a setting for stapling three portions on one side of the sheets may be selected depending on capability of the MFP 101.

Furthermore, the user may determine whether the punching process is to be performed on the printed sheets by selecting a checkbox 512 of FIG. 5A.

Furthermore, the user may determine whether the folding process is to be performed on the printed sheets by selecting a checkbox 513 of FIG. 5A.

Next, print data generated by the general print services included in the information processing apparatus will be described.

Some of these general print services determine that content of a printed matter is horizontally written from left to right and generate print data such that the left opening which is an output method suitable for the horizontal writing from left to right is attained.

However, if all printed matters are finished as the left opening, some of users may not desire such a printed matter. For example, the user may desire a printed matter of right opening. Specifically, documents in Arabic or Hebraic are horizontally written from right to left as a writing method. The horizontal writing from right to left indicates a writing method in which when a character string reaches an end of a first line, a second line is began beneath the first line, and the characters are written from right in the second line. In this way, if a document horizontally written from right to left is to be printed, a printed matter which is not desired by the user may be output unless a right-opening output method suitable for the horizontal writing from right to left is employed.

Specifically, if the user prints a document horizontally written from right in a print service designed for a Western area where documents are horizontally written from left as a service provision area, print data for left opening may be generated. It is assumed that, when the user prints a document horizontally written from right, the user sets stapling of a single portion as a print attribute. In this case, a printed matter which is stapled at an upper left corner is output although the user desires to output a printed matter which is stapled at an upper right corner which is suitable stapling position for documents horizontally written from right.

An example will be described in detail with reference to FIG. 5B. FIG. 5B is a diagram illustrating print settings and print data generated based on the print settings. As a first example of a print setting through the setting screen, an image of a portrait is printed on A4 sheets and a single portion on the printed sheets is stapled. Furthermore, as a first example of print data, print data is generated when the setting of the first example of the print setting is performed. Here, a general print service assumed in this embodiment has received a user instruction for the stapling in the single portion as illustrated in the screen of FIG. 5A and has not clearly receive a stapling position to be subjected to the stapling process. In the general print service, it is determined that a printed matter for the left opening is desired and print data in which stapling at an upper left corner of sheets is set is generated as described in the first example of the print data of FIG. 5B. Furthermore, in the print data, attributes of a job name and a file name are set based on a name of an application which has transmitted a print request to the print service and a name of a data file to be printed.

Here, it is assumed that documents horizontally written from right by Arabic, Hebraic, or the like language are printed as the left opening. In this case, a direction of a line of sight (from right to left) when the user views an object, such as characters in a printed matter, does not coincide with a direction in which the user turns over the printed matter (from left to right), and therefore, the user feels strangeness in the printed matter.

In the general print service, as with the case of the stapling process, when a punching setting illustrated as a second example of the print setting is made, print data in which a process of forming two punching holes on a left side of the sheets is set is generated provided that the left opening is employed. Note that the general print service selects "punch-dual-left" as the punching process which is executable on the left side from among the configuration information of the MFP 101 illustrated in FIG. 4. Furthermore, also in a case where a folding setting illustrated as a third example of the print setting is performed, print data indicating that an rear end of the sheets are folded in a Z-shape is generated similarly provided that the left opening is employed. If the punching process and the folding process are performed on positions for the left opening in a case of document horizontally written from right, the user feels strangeness on the printed matter.

Accordingly, the MFP 101 of this embodiment performs control for appropriately determining attributes associated with a process of outputting print data based on character information included in the print data which has received from an external apparatus. Specifically, the control is performed such that, even if attributes for the left opening are set on print data generated by an external apparatus, when it is determined that character information included in the print data indicates characters used in documents horizontally written from right, a printed matter for the right opening is output. Hereinafter, the control executed by the printing apparatus will be described in detail.

Figure 6:
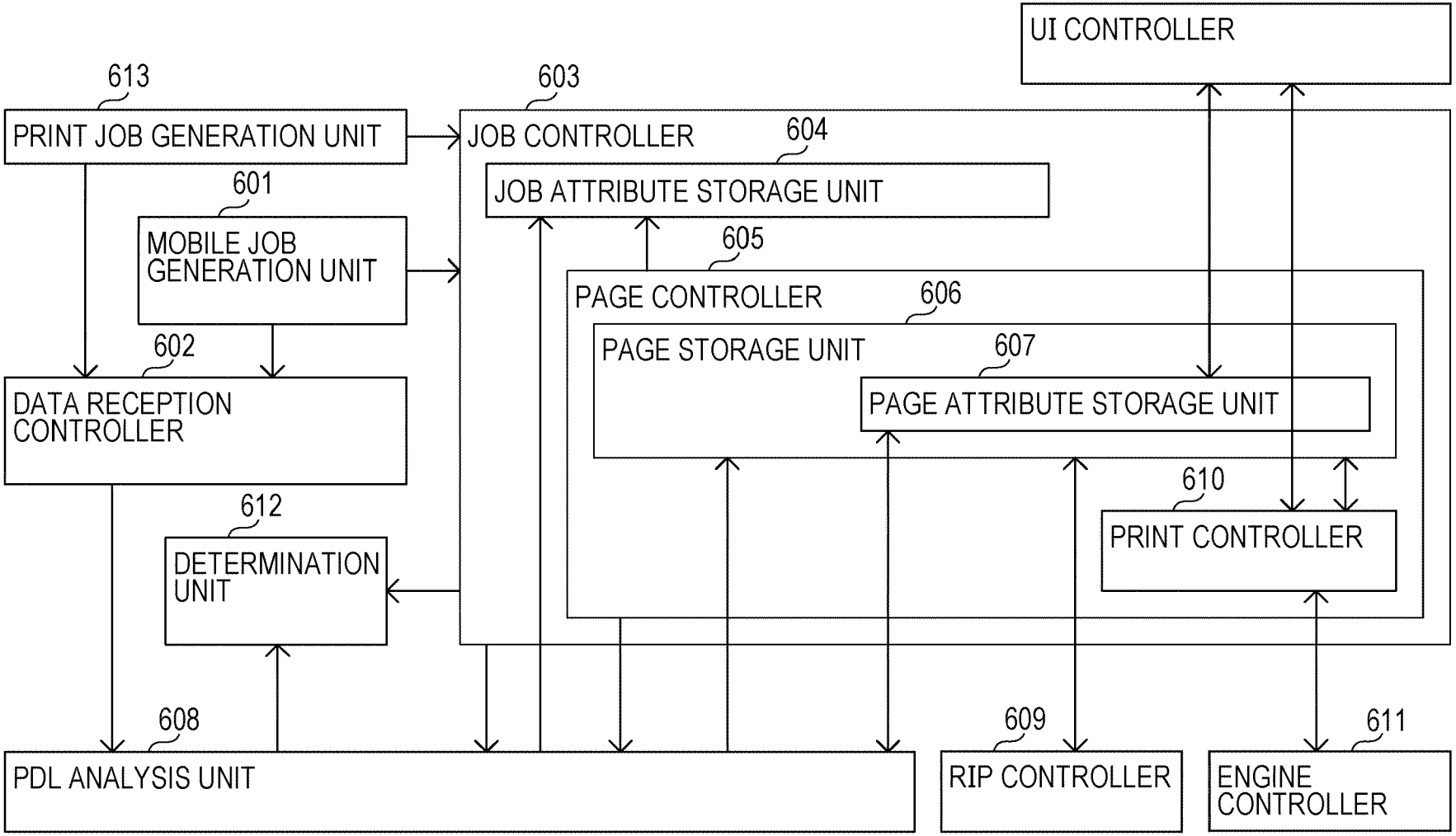
FIG. 6 is a diagram illustrating a software configuration of the MFP according to the first embodiment of the present disclosure.

FIG. 6 is a block diagram illustrating control modules included in the MFP 101 according to this embodiment. Software modules 601 to 608 and software modules 612 and 613 are mainly executed by the CPU 111 illustrated in FIG. 2. Furthermore, an RIP controller 609 is a hardware module mainly executed by the image processing unit 124. An engine controller 611 is a control module mainly executed by a controller (not illustrated) included in the printing unit 120.

A mobile job generation unit 601 is a module which receives print data through a network using an Internet printing protocol (IPP) and generates a print job. When receiving print data based on the IPP from an external apparatus, such as the mobile terminal 103, the mobile terminal 104, or the PC 105, the mobile job generation unit 601 writes the received print data in a data reception controller 602. Furthermore, the mobile job generation unit 601 generates a mobile print job used to manage a status of printing, registers the mobile print job in a job controller 603, and transmits a request for performing a print process. Furthermore, the mobile job generation unit 601 determines whether the received print data has been generated in a certain print service and stores the print data in a job attribute storage unit 604 described below.

A print job generation unit 613 receives print data generated by a printer driver designed for the MFP 101 (or a print application) through the network and generates a print job. Furthermore, the print job generation unit 613 receives print data through the network using a line printer daemon (LPR) protocol and generates a print job. The print job generation unit 613 which has received the print data writes the received print data in the data reception controller 602, registers the generated print job in the job controller 603, and requests a print process.

The data reception controller 602 is a module which manages the print data received by the mobile job generation unit 601 or the print job generation unit 613 and stores print data for each print job.

Next, the execution of the print process will be described. The job controller 603 manages the execution of a print job registered in the job controller 603. The job controller 603 instructs a page description language (PDL) analysis unit 608 to analyze print data of the registered print job. The PDL analysis unit 608 receives print data corresponding to the print job from the data reception controller 602, analyzes the print data, and generates page data and print attributes associated with pages. The generated page data is managed by a page controller 605. The print attributes associated with the pages are managed by a page attribute storage unit 607. The page attribute storage unit 607 stores the print attributes for individual pages generated by the PDL analysis unit 608 which are associated with a job ID and corresponding page IDs. For example, information on a sheet size, a sheet type, and stapling allowance corresponds to the print attributes associated with pages. In this embodiment, the stapling allowance is a term indicating one end (an upper end, a lower end, a right end, or a left end) of a sheet which serves as a reference when the printed matter is turned over or when the printed matter is subjected to the post-processing.

The job attribute storage unit 604 manages print attributes associated with a print job. The job attribute storage unit 604 stores print attributes including the job name and the file name obtained from the mobile job generation unit 601 or the print job generation unit 613 when the print job is generated from the print data while the print attributes are associated with the print job. Furthermore, the job attribute storage unit 604 stores a print attribute of the post-processing to be executed on the printed matter and a print attribute of a setting of both-side printing while the print attributes are associated with the print job. Furthermore, as a print attribute associated with the print job, information on a text object included in the print data may be stored. These print attributes are managed while being associated with the job ID assigned to the print job when the print job is generated.

In this embodiment, the print attributes associated with the pages managed by the page attribute storage unit 607 and the print attributes associated with the print job managed by the job attribute storage unit 604 are collectively referred to as the print attributes.

The job controller 603 requests a determination unit 612 to determine whether a character code for one character is included in a predetermined character code space only when it is determined that the print job is generated by a predetermined print service. The determination unit 612 determines whether a character code for one character is included in a predetermined character code space and transmits a result of the determination to the job controller 603. When the determination unit 612 determines that a character which is used in the horizontal writing from right is included, the job controller 603 performs a process of updating job attribute information so that the right opening is appropriately performed. A method for the determination and a method for the update will be described in detail with reference to flowcharts below.

The determination process and the update process are not performed on print data received through the printer driver or the LPR protocol. Furthermore, the processes are not performed even if it may be determined that the print data is generated by the print service in which the user may specify a position of the post-processing even if the print data is received by the mobile job generation unit 601.

Specifically, the MFP 101 causes the determination unit 612 to make the determination and update the job attributes based on a result of the determination when receiving print data generated by the predetermined print service which generates print data of the left opening.

The page controller 605 controls an RIP process of the RIP controller 609 and a print control process of a print controller 610. The RIP controller 609 receives the page data analyzed by the PDL analysis unit 608 in accordance with an instruction issued by the page controller 605 and generates a print image in cooperation with the image processing unit 124. The generated print image is managed by a page storage unit 606. The print controller 610 obtains the print image from the page storage unit 606 and transfers the obtained print image to the engine controller 611 after performing color separation on the print image by cyan (C), magenta (M), yellow (Y), and black (K). Furthermore, the print controller 610 obtains the job attributes and the page attribute information from the page attribute storage unit 607 and the job attribute storage unit 604. The print controller 610 determines a size and a type of sheets to be used in printing, a feeding direction of sheets, and a direction of printing of the print image on sheets, and performs control such that appropriate sheets are fed from a sheet feeding cassette, not illustrated. The engine controller 611 causes the printing unit 120 to perform printing on the sheets based on received color data of C, M, Y, and K.

Next, a method for the determination performed by the determination unit 612 and control of the update process performed by the job controller 603 described above will be described with reference to flowcharts in FIGS. 7 to 9 and FIG. 11. FIGS. 7 to 9 and FIG. 11 are flowchart of control performed when the MFP 101 receives print data from an external apparatus. Operations (steps) in the flowcharts of FIGS. 7 to 9 and FIG. 11 are realized when the CPU 111 reads control programs which are stored in the ROM 112 or the storage 114 and which realize the control modules into the RAM 113 and executes the control programs. Note that some of the operations in the flowcharts are realized when the control programs which realize corresponding modules which are to be executed by the CPU 111, the various interfaces included in the controller 110, and the various units connected to the controller 110 appropriately operate in cooperation.

In step S701, the CPU 111 determines whether a generation source of the received print data is the predetermined print service. When a protocol used when the print data is received is not the IPP, the determination is negative and the process proceeds to step S708. Specifically, the CPU 111 determines that the protocol when the print data is received is the IPP in a case where a predetermined port number (a 631-th port, for example) is used when the print data is received.

On the other hand, when the protocol used when the print data is received is the IPP, the generation source of the print data is determined based on information included in the received print data. For example, the CPU 111 determines whether a print service of the generation source is the predetermined print service based on User-agent information included in a hypertext transfer protocol (HTTP) header obtained when the print data is received. When the determination is affirmative, the process proceeds to step S702, and otherwise, the process proceeds to step S708.

In step S702, the CPU 111 generates a mobile print job based on the received print data. Furthermore, the CPU 111 stores the job attributes in the job attribute storage unit 604 based on the received print data and stores the page attributes in the page attribute storage unit 607 based on the received print data. On the other hand, in step S708, the CPU 111 generates a print job based on the received print data. Furthermore, the CPU 111 stores the job attributes in the job attribute storage unit 604 based on the received print data and stores the page attributes in the page attribute storage unit 607 based on the received print data.

Note that, although a case where format information and a type of protocol used in reception are used when it is determined whether the generation source of the print data is a predetermined type of print service in this embodiment, the present disclosure is not limited to this. For example, it may be determined that the generation source is the predetermined type of print service when the generation source is a specific print service of a specific version. In this process, only when the print data is received from the print service for generating a print job for the left opening, the control in step S703 to step S707 may be performed.

In step S703, the CPU 111 obtains a character string of a job name included as one of the print attributes of the print job generated in step S702. In step S704, the CPU 111 obtains a character string of a file name included as one of the print attributes of the print job generated in step S702.

In step S705, the CPU 111 performs a process of determining the character strings obtained in step S703 and step S704. The determination process is performed mainly by the module of the determination unit 612 described above. The process will be described in detail with reference to a flowchart below. Note that, when it is determined that switching to the right opening is required in the determination process, a right-opening flag stored in the RAM 113 is updated to TRUE.

In step S706, the CPU 111 determines whether the right-opening flag is TRUE. When the determination is affirmative, the process proceeds to step S707, and otherwise (FALSE), step S707 is skipped and the process proceeds to step S709.

In step S707, the CPU 111 updates the print attributes to those for the right opening and the process proceeds to step S709. The update process will be described with reference to a flowchart below.

In step S709, the CPU 111 performs the print process based on the print job in cooperation with the image processing unit 124 and the printing unit 120. When the print on the sheets is completed, the process proceeds to step S710.

In step S710, the CPU 111 executes the post-processing on the sheets in cooperation with the sheet processing unit 122. The CPU 111 controls the sheet processing unit 122 based on attribute information associated with the post-processing obtained by analyzing the print job and page attribute information associated with pages. The sheet processing unit 122 executes a stapling process of stapling printed sheets, a folding process of folding the printed sheets, and a punching process of forming punching holes on the printed sheets where appropriate based on a control instruction issued by the CPU 111 and discharges the sheets to a sheet discharge tray, not illustrated.

By the series of operations described above, printing may be performed in a format suitable for the right opening in a case where it is determined that a change to the right opening is required in the determination process when print data is received from the external apparatus and the print process is performed.

Determination Process

Figure 8:
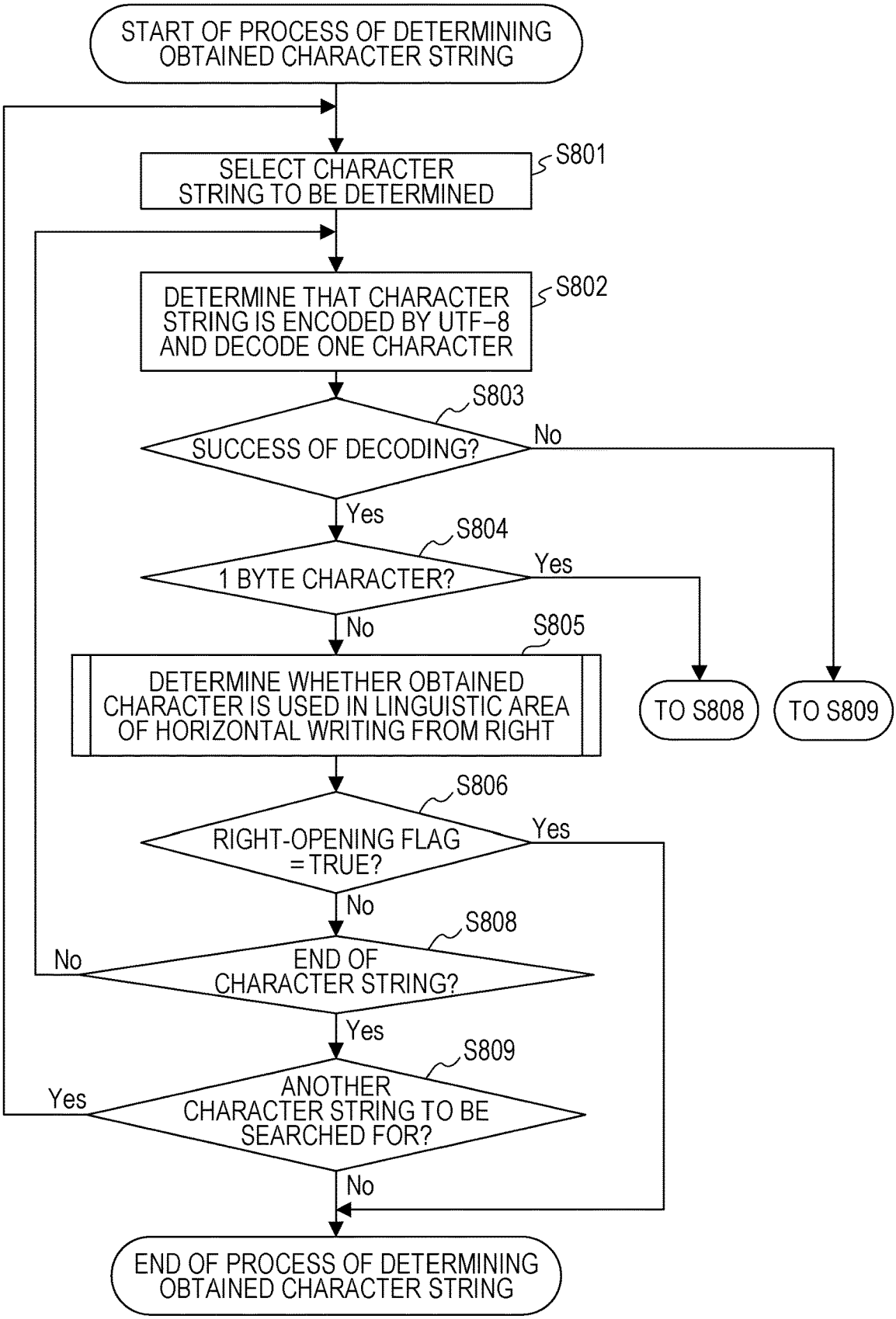
FIG. 8 is a flowchart of the print control according to the first embodiment.
Figure 9:
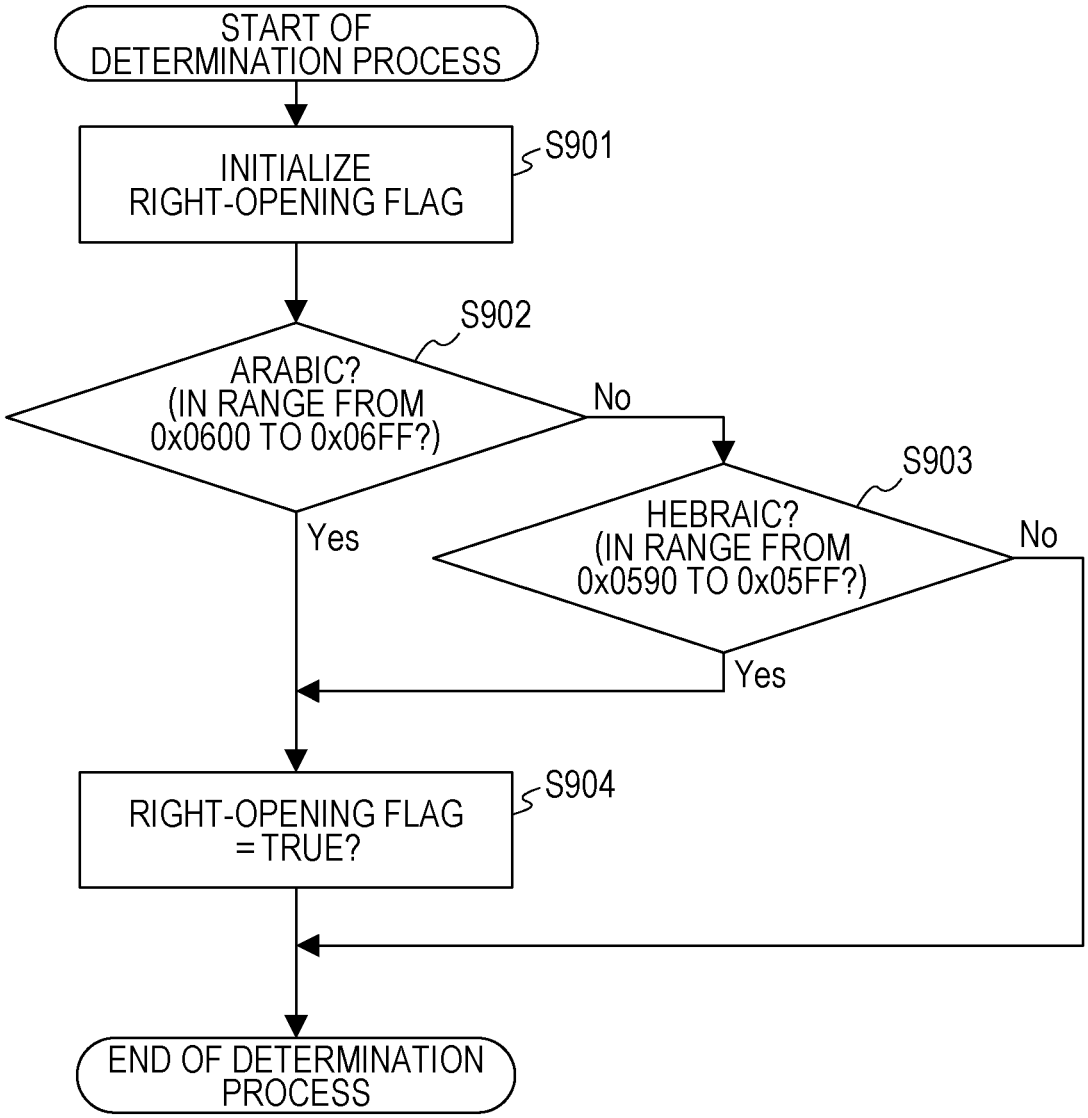
FIG. 9 is a flowchart of the print control according to the first embodiment.

Next, the determination process based on the obtained character string will be described with reference to flowcharts of FIGS. 8 and 9. The operations in the flowcharts of FIGS. 8 and 9 are realized mainly by the control module corresponding to the determination unit 612.

In step S801, the CPU 111 selects a character string of a searching target from among a plurality of character strings which are determination targets obtained in step S703 or step S704. In step S802, the CPU 111 determines that a character code is encoded by Unicode transformation format-8 (UTF-8) and performs a decoding process for one character based on an encoding rule of the UTF-8. In the decoding process, the character string encoded by UTF-8 is interpreted and decoded into a character code for one character represented by Unicode.

In step S803, the CPU 111 determines whether decoding has been successfully performed. When the decoding to the character code of Unicode is successfully performed based on the encoding rule of UTF-8, it is determined that the encoding has been performed based on UTF-8 and the process proceeds to step S804. When the decoding to a character code space of Unicode has not been successfully performed based on the encoding rule of UTF-8, it is determined that the encoding has been performed by an encoding method other than UTF-8 and the process proceeds to step S809.

In step S804, the CPU 111 determines whether the decoded character for one character corresponds to 1 byte. When the determination is affirmative, the process proceeds to step S808, and otherwise, the process proceeds to step S805.

Note that, in Unicode, a character corresponding to an American standard code for information interchange (ASCII) code is mapped as a 1 byte character. The ASCII code is a character set mainly including Latin characters used in English-speaking countries and western European linguistic area and does not include unique characters used in a linguistic area where characters are horizontally written from right as the writing direction.

According to the process in step S804, in a case of ASCII characters which do not include unique characters used in a linguistic area where the characters decoded in step S802 are horizontally written from right in the writing direction, the determination on a character may be omitted.

In step S805, the CPU 111 determines whether the obtained character is the unique character used in the linguistic area where characters are horizontally written from right in the writing direction. The process in step S805 will be described in detail with reference to the flowchart of FIG. 9 and character code spaces illustrated in FIGS. 10A and 10B.

In step S901, the CPU 111 initializes the right-opening flag to FALSE. The initialized right-opening flag is stored in the RAM 113 and appropriately referred to in a step described below.

In step S902, the CPU 111 determines whether the obtained code data for one character is included in a character code space (0x0600 to 0x06FF) of an Arabic-speaking world. When the determination is affirmative, the process proceeds to step S904. On the other hand, when the determination is negative, the process proceeds to step S903.

In step S903, the CPU 111 determines whether the obtained code data for one character is included in a character code space (0x0590 to 0x05FF) of an Hebraic-speaking world. When the determination is affirmative, the process proceeds to step S904. On the other hand, when the determination is negative, the determination process for one character is terminated and the process proceeds to step S806. Note that order of execution of step S902 and step S903 may be reversed. Furthermore, the character code space of the Hebraic-speaking world and the character code space of the Arabic-speaking world are consecutive in Unicode, and therefore, it may be collectively determined whether the obtained code data for one character is included in a range from 0x0590 to 0x06FF.

In step S904, the CPU 111 changes the right-opening flag to TRUE and the process proceeds to step S806.

As illustrated in FIG. 10B, Arabic characters used in the Arabic-speaking world are assigned to character codes in the range from 0x0600 to 0x06FF. In the Arabic-speaking world, documents are horizontally written from right, and therefore, when a character included in the character code space of Arabic characters is detected, the flag for updating the print attributes to the right-opening basis is set to be TRUE before the update process described below is performed. Furthermore, Hebraic characters used in the Hebraic-speaking world are assigned to character codes in the range from 0x0590 to 0x05FF. Also in the Hebraic-speaking world, documents are horizontally written from right similarly to the Arabic-speaking world, and therefore, when a Hebraic character is detected, the flag for updating the print attributes to the right-opening basis is set to be TRUE before the update process described below is performed. Note that, in this embodiment, the character code space of the Arabic characters is referred to as a character set in the Arabic-speaking world and the character code space of the Hebraic characters is referred to as a character set in the Hebraic-speaking world.

Referring back to FIG. 8, it is determined whether the right-opening flag is TRUE in step S806. When the right-opening flag is TRUE, the series of determinations on the character string is terminated and the process proceeds to step S706. Accordingly, when at least one Arabic character or at least one Hebraic character is included in the character string, the print attributes are updated to the right-opening basis. On the other hand, when the right-opening flag is not TRUE (that is, FALSE), the process proceeds to step S808.

In step S808, the CPU 111 determines whether the searching has been performed on an end of the character string obtained in step S801. When the character of the determination target corresponds to the end of the character string, it is determined that the searching has been performed on the end of the character string and the process proceeds to step S809. When the character of the determination target does not correspond to the end of the character string (that is, the character is followed by another character), the process returns to step S802 and the determination is performed again on the subsequent character in the character string.

In step S809, the CPU 111 determines whether another character string is to set to be a searching target. When the determination is affirmative, the process returns to step S801 and the determination is performed on the other character string. On the other hand, when the determination is negative, the determination process on the obtained character string is terminated and the process proceeds to step S706.

In step S706, the CPU 111 determines whether the right-opening flag stored in the RAM 113 is TRUE. When the determination is affirmative, the process proceeds to step S707, and otherwise (FALSE), step S707 is skipped and the process proceeds to step S709.

Note that, although the case where the attribute information of the print data is updated to the right-opening basis when an Arabic character or a Hebraic character is included in the job name or the file name of the print job in the process illustrated in FIGS. 8 and 9 is described in this embodiment, the present disclosure is not limited to this. For example, the update to the right-opening basis may be performed also in a case where a Syrian character used in an Assyrian-speaking world or a character of an ancient language or the like which is horizontally written from right in documents is included in the character string. In this case, the CPU 111 further performs a determination as to whether the character of the searching target is included in a character code space of the Syrian character or a character code space of an ancient language or the like which is horizontally written from right in documents.

Furthermore, although the case where the job name and the file name is encoded by UTF-8 is described in this embodiment, the present disclosure is not limited to this. For example, this embodiment may be applied to a case where the job name or the file name is encoded by another character encoding method. In this case, the CPU 111 determines an encoding method of a character string using one character or a plurality of characters from the top instead of the process in step S802. Next, decoding is performed on characters based on a rule of the encoding method obtained as a result of the determination. Furthermore, a determination as to whether the character is in a right-opening cultural area as illustrated in step S805 based on a character code obtained by the decoding.

Update Process

Figure 11:
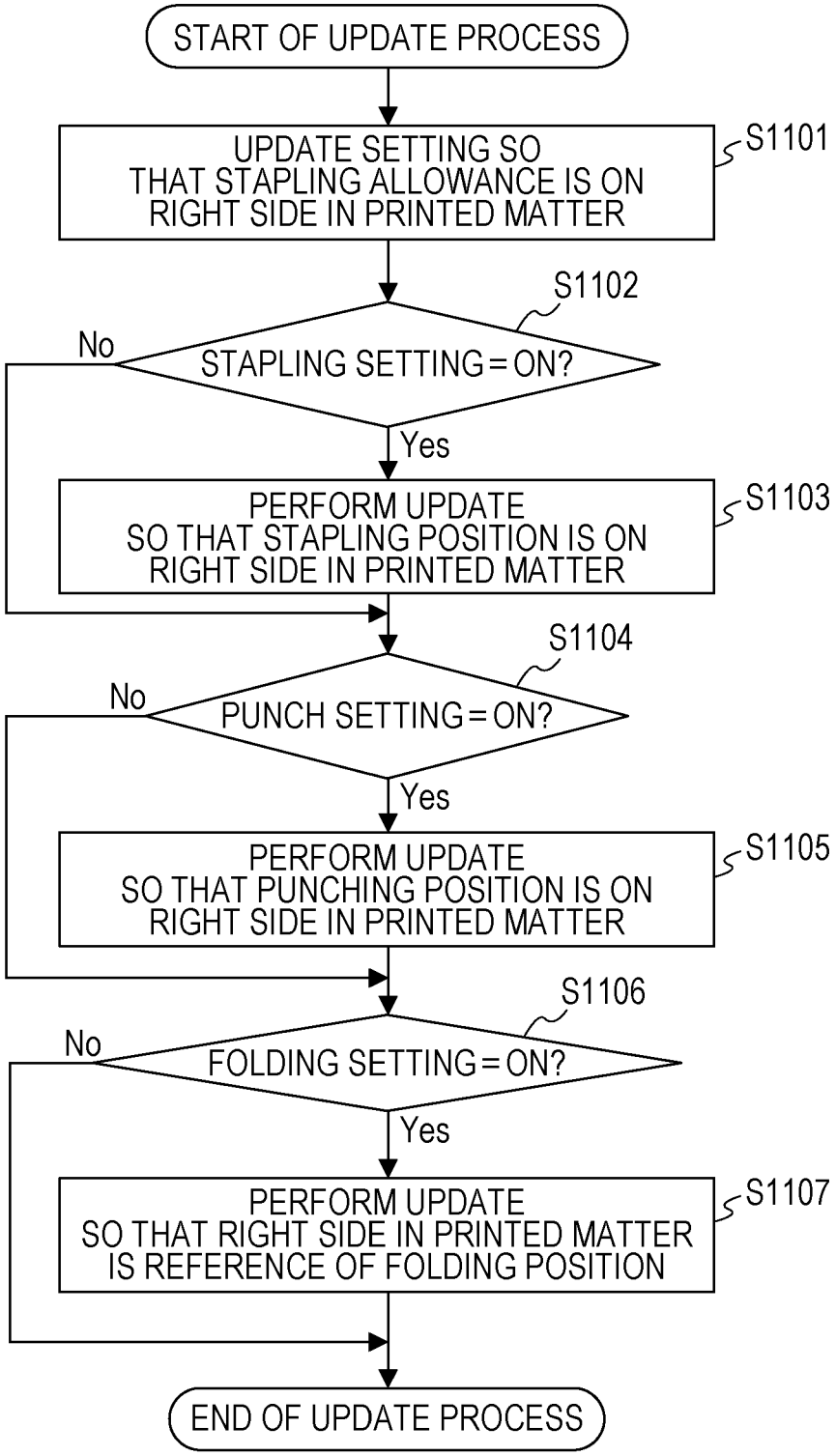
FIG. 11 is a flowchart of the print control according to the first embodiment of the present disclosure.
Figure 12:
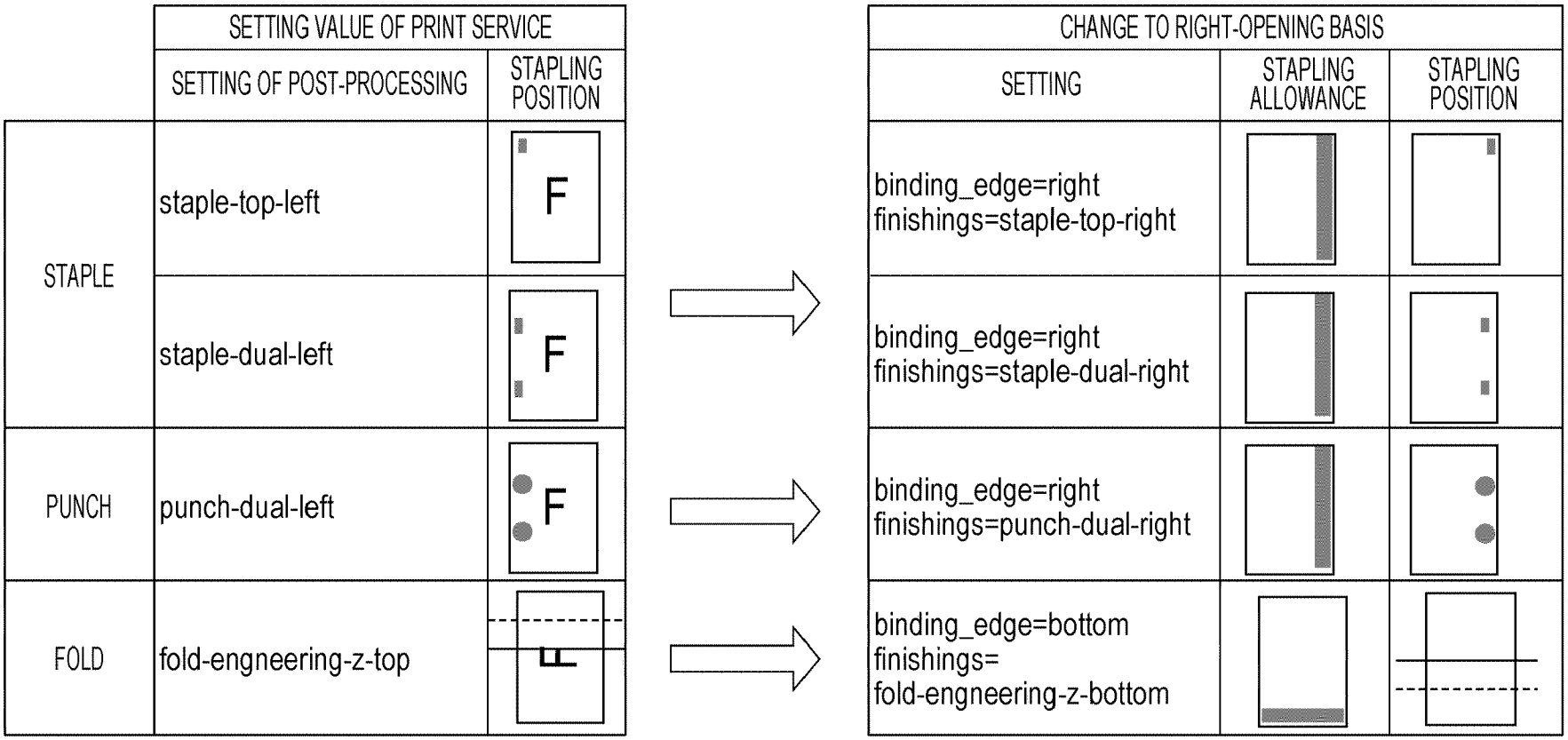
FIG. 12 is a diagram illustrating update to attribute information based on right opening.

Next, the process of updating the print attributes of the print job to a setting based on the right opening performed in step S707 will be described using a flowchart of FIG. 11 and FIG. 12 which is a diagram illustrating update of attribute information to the right-opening basis. The processes in the steps of FIG. 11 are realized when a control module corresponding to the job controller 603 mainly accesses and updates the attributes managed by the job attribute storage unit 604 and the page attribute storage unit 607.

In step S1101, the CPU 111 updates an attribute of stapling allowance so that the stapling allowance stored as page attribute information is positioned on a right side in the printed matter. As illustrated in FIG. 12, the update is performed so that an attribute indicating that a right end of the printed matter corresponds to the stapling allowance relative to the print data set on the left-opening basis.

In step S1102, the CPU 111 determines whether the stapling process is set as a job attribute of the print job. When the determination is affirmative, the process proceeds to step S1103, and otherwise, the process proceeds to step S1004.

In step S1103, the CPU 111 updates a position of the stapling process in accordance with the stapling allowance. Specifically, in a case where a single portion is to be stapled as a setting of the stapling process, "staple-top-right" is set as update so that the stapling process is performed on an upper right portion of the printed matter. On the other hand, in a case where two portions are to be stapled as a setting of the stapling process, "staple-dual-right" is set as update so that the stapling process is performed on two portions on the right end of the printed matter.

In step S1004, the CPU 111 determines whether the punching process is set as a job attribute of the print job. When the determination is affirmative, the process proceeds to step S1105, and otherwise, the process proceeds to step S1106. In step S1105, the CPU 111 updates a position of the punching process in accordance with the stapling allowance. Specifically, "punch-dual-right" is set as update so that the punching process is performed on the right side in the printed matter.

In step S1106, the CPU 111 determines whether the folding process is set as a job attribute of the print job. When the determination is affirmative, the process proceeds to step S1107, and otherwise, the process of update to the right-stapling basis is terminated and the process proceeds to the print process in step S709.

In step S1107, the CPU 111 updates a position of the folding process in accordance with the stapling allowance. Specifically, the setting of the folding process is updated to "fold-engineering-z-bottom" so that the folding process is performed on the right side in the printed matter and the process proceeds to the print process in step S709. Accordingly, the print process and the post-processing on the printed sheets are performed based on the attributes changed in the process from step S1101 to step S1107.

As described above, when it is determined that the character string indicating the job name or the file name included in the print data is constituted by characters for documents horizontally written from right, the setting may be changed so as to be suitable for the printed matter based on the right opening.

Accordingly, even when print data generated by the print service for generating print data based on the left opening is received, the printed matter of a form desired by the user may be output whenever possible.

Furthermore, a result of the determination as to whether the setting of the printed matter is changed so that the printed matter based on the right opening is obtained may be appropriately switched in accordance with the generation source of the print data. Accordingly, in a case where the print data generated by a printer driver which may clearly determine a position of the post-processing to be performed on the sheets is received, the printed matter may be output without updating the setting based on character information.

Second Embodiment

In the first embodiment, the case where it is determined whether a character string indicating a job name or a file name includes a character string for describing documents by horizontal right writing when print data is to be printed is described.

In a second embodiment, in addition to the process of the first embodiment, a process of determining a text object included as content of received print data is further described. Note that, in the second embodiment, an assumed hardware configuration of an apparatus is the same as that of the first embodiment. Furthermore, detailed descriptions of components the same as those of the first embodiment are omitted.

Figure 13:
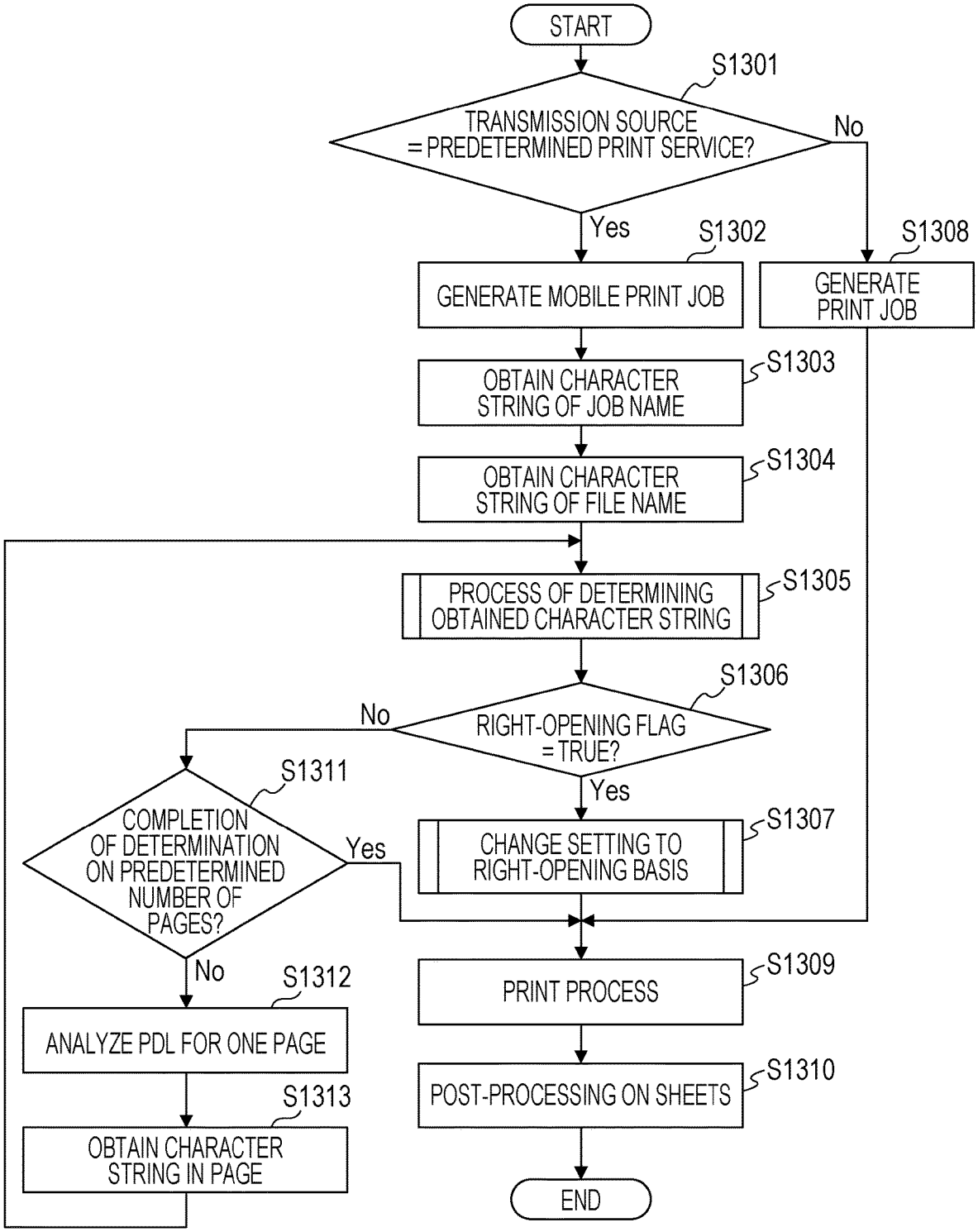
FIG. 13 is a flowchart of print control according to a second embodiment.

FIG. 13 is a flowchart of control performed when an MFP 101 receives print data from an external apparatus. In the second embodiment, control is performed when print data is received based on a flowchart illustrated in FIG. 13 instead of FIG. 7 of the first embodiment. In the second embodiment, the CPU 111 executes control in step S1311 to step S1313 in addition to the process of the first embodiment.

A process from step S1301 to step S1305 is the same as the process from step S701 to step S705 of the first embodiment, and therefore, a description thereof is omitted.

In step S1306, a CPU 111 determines whether a right-opening flag is TRUE. When the determination is affirmative, the process proceeds to step S1307, and otherwise (FALSE), the process proceeds to step S1311.

A process from step S1307 to step S1310 is the same as the process from step S707 to step S710 of the first embodiment, and therefore, a description thereof is omitted.

In step S1311, the CPU 111 determines whether a determination on character strings included in content for a predetermined number of pages has been completed. When the determination of the character strings included in the content for a predetermined number of pages (one page, for example) is completed, the process proceeds to a print process in step S1309, and otherwise, the process proceeds to step S1312.

Note that, although one page is illustrated as an example of a predetermined number of pages in this embodiment, the present disclosure is not limited to this. For example, the predetermined number of pages may be 2 pages or 3 pages taking a front page included in the print data into consideration. Furthermore, the discrimination process may be performed on all the pages included in the print data.

In step S1312, the CPU 111 generates page data for one page using the print data. In step S1313, the CPU 111 obtains a character string included in a text object included in the page data generated in step S1312. Here, when a plurality of text objects are included in the page data, character strings corresponding to the individual text objects are obtained. When the obtainment of the character string is completed, the process returns to step S1305 where the determination process is performed on the character string included in the page data.

In a case where it is determined that a character used in documents horizontally written from right is included after the determination is performed also on characters included as content of the print data received in the process from step S1311 to step S1313, a setting may be changed so that a printed matter for right opening is obtained. Accordingly, even when a job name or a file name is represented by alphanumeric characters, a document horizontally written from right may be determined using character information of the content of the print data, and accordingly, a printed matter of a form desired by the user may be more reliably output.

Third Embodiment

In the first embodiment, the case where it is determined whether a character string indicating a job name or a file name includes a character string for horizontally writing documents from right when print data is to be printed is described.

In a third embodiment, in addition to the process of the first embodiment, control performed taking a Japanese-speaking world and a portion of a Chinese-speaking world (such as Taiwan) into consideration is further described. Note that, in the third embodiment, an assumed hardware configuration of an apparatus is the same as that of the first embodiment. Furthermore, detailed descriptions of components the same as those of the first embodiment are omitted.

In the Japanese-speaking world and the Chinese-speaking world, documents horizontally written from left and documents vertically written from right are used. Here, the vertical writing from right is a writing method described as follows. That is, characters are vertically arranged from top to bottom and when a character string has reached an end of a line, a writing line is shifted leftward by one line and writing is performed on the line from a top. A document described in this writing method is preferably output as a right-opening document of an output form suitable for vertical writing from right.

Therefore, in this embodiment, it is assumed that a user in the Japanese-speaking world or the Chinese-speaking world desires to perform printing mainly on a printed matter vertically written from right, and control is performed so that a printed matter based on right stapling may be generated even in a case where a character in the Japanese-speaking world or the Chinese-speaking world is included.

However, in the Japanese-speaking world and the Chinese-speaking world, the horizontal writing and the vertical writing are used depending on characteristics of a document as described above. Therefore, if a printed matter based on the right stapling is output in a case where a character of the Japanese-speaking world or the Chinese-speaking world is included, usability for the user is degraded.

Therefore, in this embodiment, a default setting (prescribed setting) used when a position of post-processing is not clearly specified is used so that a printed matter based on the right stapling may be output when a character of the Japanese-speaking world or the Chinese-speaking world is included in print data.

Figure 14:
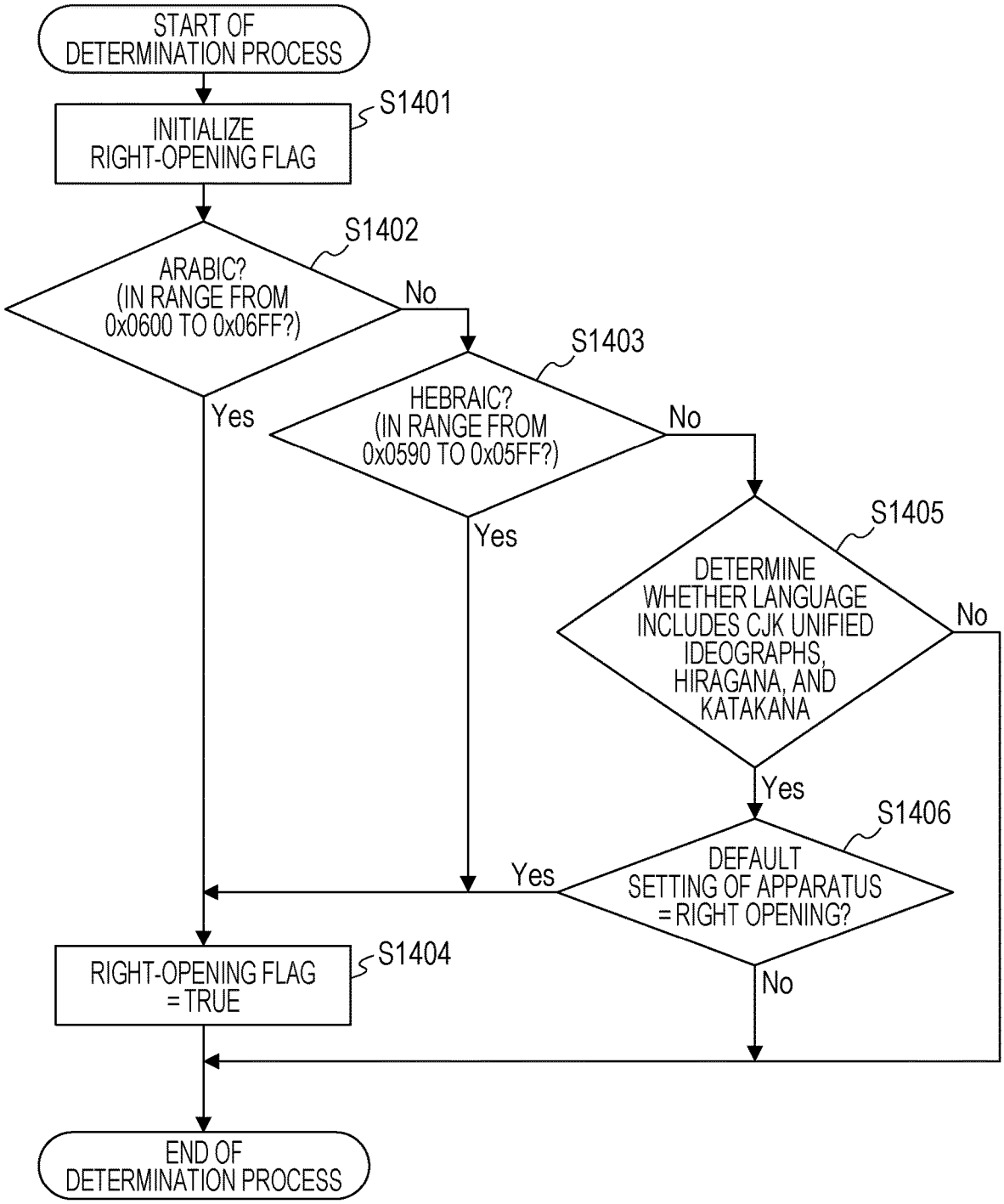
FIG. 14 is a flowchart of print control according to a third embodiment.

A concrete process will be described with reference to a flowchart of FIG. 14. In the third embodiment, a determination process performed for each character based on the flowchart of FIG. 14 is executed instead of the determination process performed for each character illustrated in FIG. 9 of the first embodiment.

Figure 7:
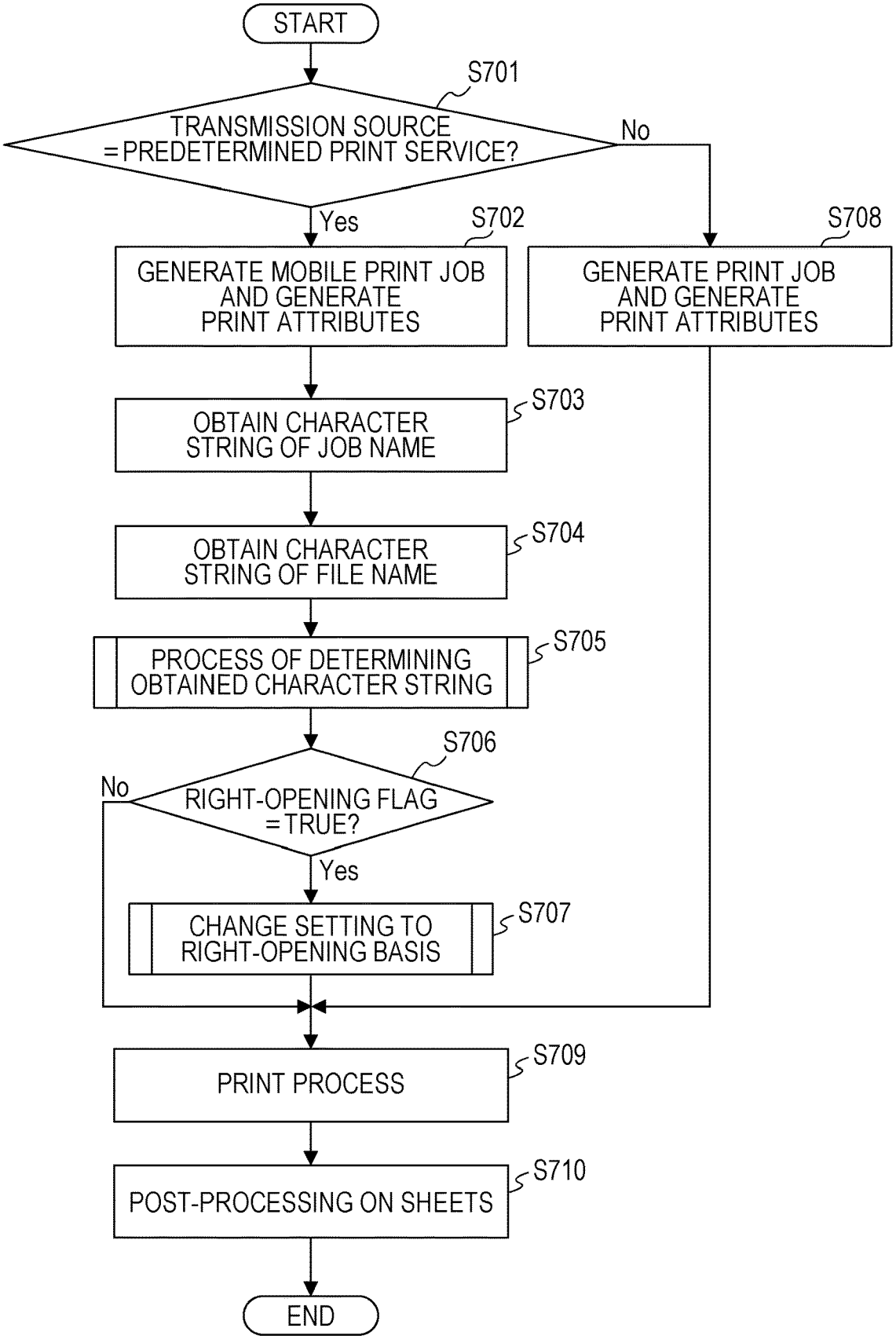
FIG. 7 is a flowchart of print control according to the first embodiment.

Note that print control according to the first embodiment illustrated in FIGS. 7, 8, and 11 is the same as that of the third embodiment, and therefore, a description of the print control of the third embodiment is omitted.

In the control according to the third embodiment, a CPU 111 executes control in step S1405 and step S1406 in addition to the process of the first embodiment.

A process in step S1401 and step S1402 is the same as the process in step S901 and step S902 of the first embodiment, and therefore, a description thereof is omitted.

In step S1403, the CPU 111 determines whether obtained code data for one character is included in a character code space (0x0590 to 0x05FF) of the Hebraic-speaking world. When the determination is affirmative, the process proceeds to step S1404, and otherwise, the process proceeds to step S1405. A flag update process in step S1404 is the same as the process in step S904 of the first embodiment, and therefore, a description thereof is omitted.

In step S1405, the CPU 111 determines whether the obtained code data for one character is included in a character code space of CJK unified ideographs (CJK stands for Chinese, Japanese, and Korean), Hiragana, or Katakana. When the determination is affirmative, the process proceeds to step S1406. On the other hand, when the determination is negative, the determination process for each character is terminated and the process proceeds to a determination to be performed on a subsequent character in the character string.

In step S1406, the CPU 111 determines whether the setting is for right opening with reference to the default setting. When the determination is affirmative, the process proceeds to step S1404, and otherwise, the determination process for one character is terminated and the determination process is performed on a subsequent character in the character string.

In this embodiment, a default setting (prescribed setting) used when a position of post-processing is not clearly specified is used so that a printed matter based on the right stapling may be output when a character of the Japanese-speaking world or the Chinese-speaking world is included in print data.

Accordingly, the user who desires to mainly print a printed matter vertically written from right changes the default setting to the setting suitable for the right opening so as to output a printed matter of a desired format even when a print service for the left opening is used.

Note that, although the case where it is determined whether a character is included in the character code space of the CJK unified ideographs, Hiragana, or Katakana in step S1405 is described in this embodiment, the present disclosure is not limited to this. The determination based on any character code space may be made if other characters are vertically written from top to bottom, the writing proceeds to left by one line when a character string reaches an end of a line, and the writing is continued from top of the next line.

Note that, although the case where the third embodiment is applied to the first embodiment is described, the present disclosure is not limited to this. The process of the third embodiment may be applied to the second embodiment.

Fourth Embodiment

In the third embodiment, the control is performed taking the case where a character of the Japanese-speaking world or a portion of the Chinese-speaking world (such as Taiwan) is included into consideration. In a fourth embodiment, control is performed taking a case where received print data is temporarily spooled in a storage 114 or the like into consideration in addition to the third embodiment.

An MFP 101 of this embodiment is capable of temporarily spooling print data supplied from an information processing apparatus in the storage 114. A user selects spooled print data by operating an operation unit 116 of the MFP 101 so as to print the data (hereinafter referred to as "spool printing".

The user performs an operation of selecting print data before the spool printing is actually performed. In this embodiment, the user operation performed before printing is actually performed is focused, and control for transmitting an inquiry to the user as to whether a format desired by the user is attained is performed in a series of user operations performed before the printing is started.

In this case, when the spool printing is performed, an inquiry about the format may be transmitted to the user, and accordingly, printing of a format desired by the user may be more reliably performed even in an environment in which both of the horizontal writing and the vertical writing are used depending on characteristics of documents in the Japanese-speaking world, the Chinese-speaking world, and the like.

Reception and Spooling of Print Data

Figure 15:
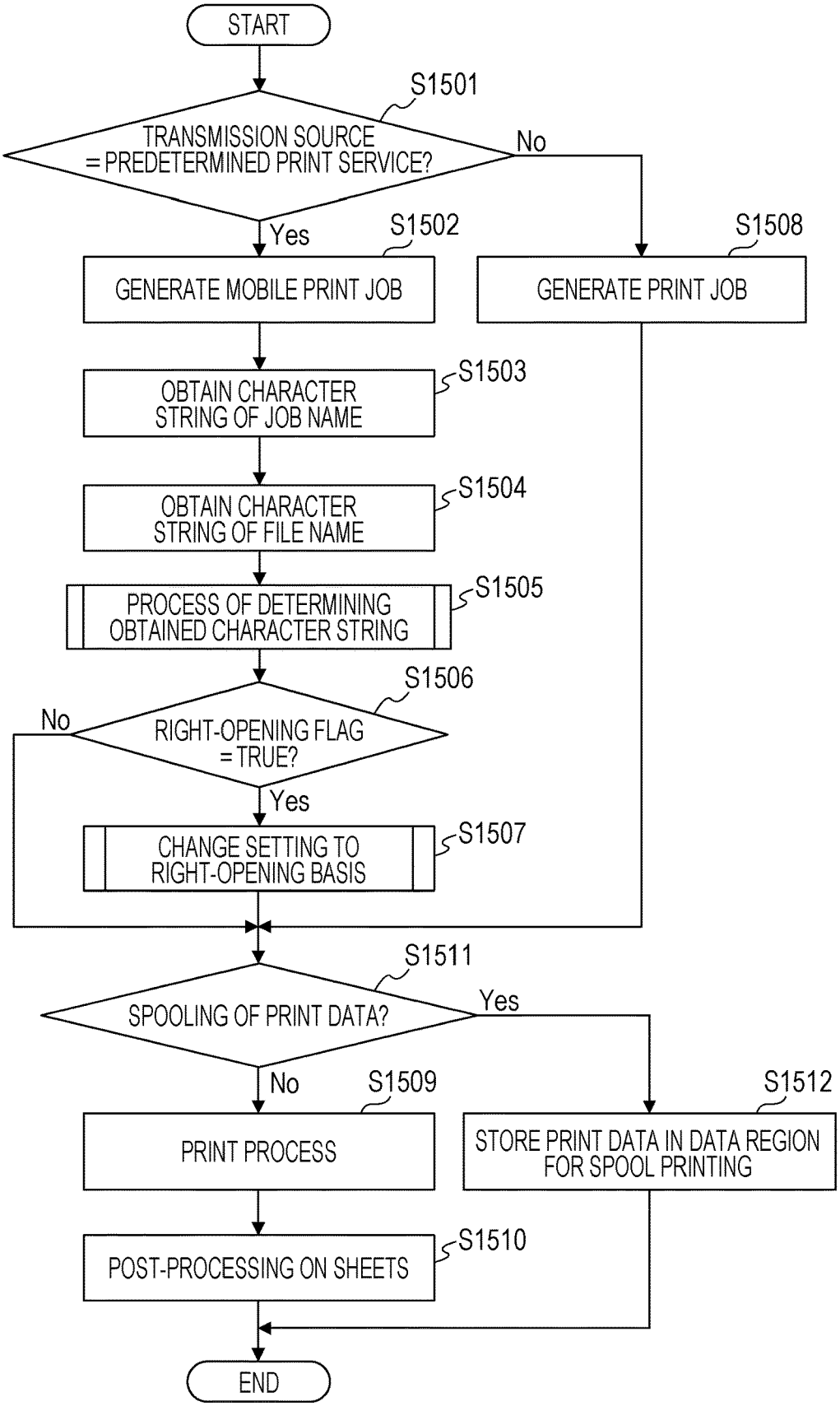
FIG. 15 is a flowchart of print control according to a fourth embodiment.
Figure 16:
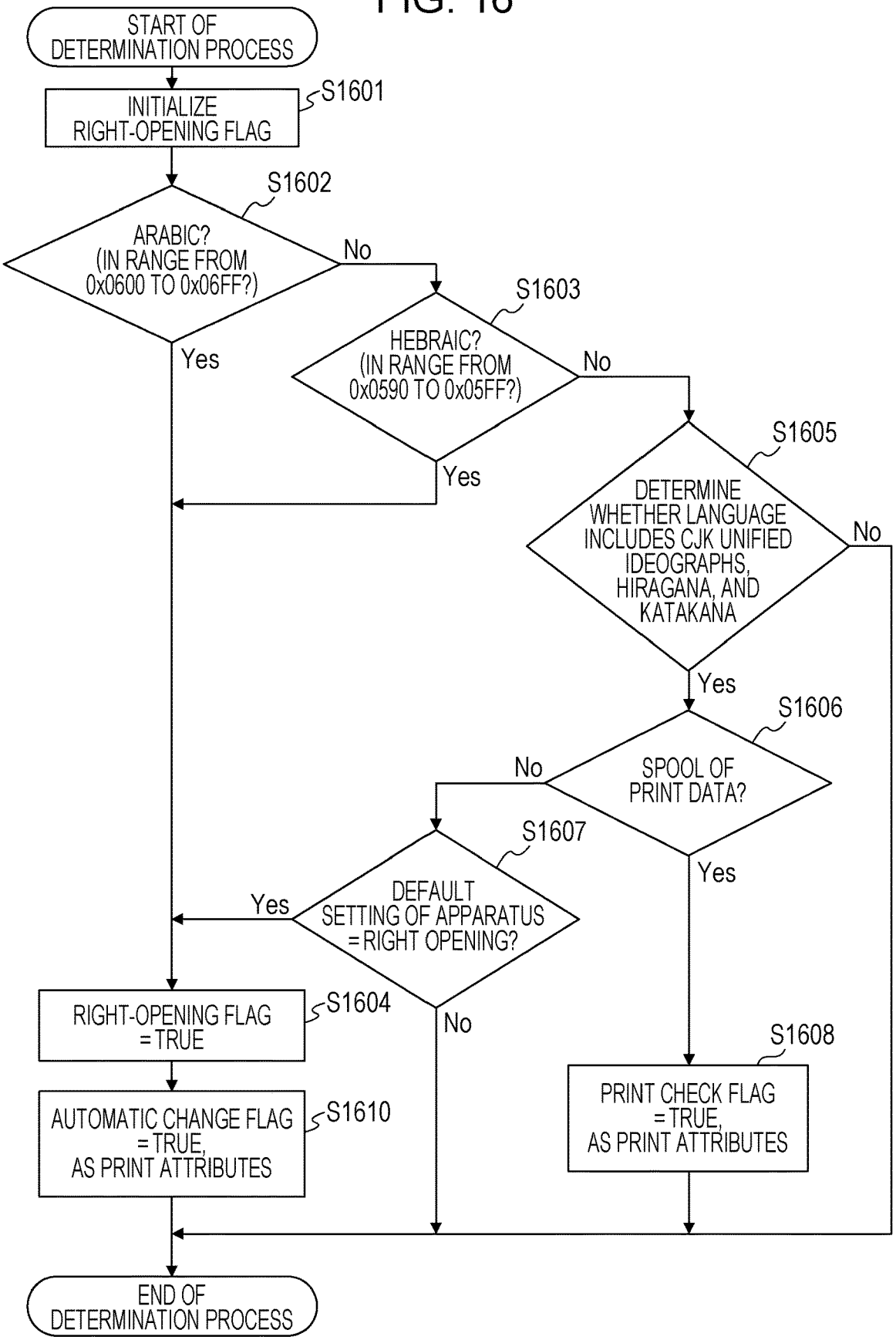
FIG. 16 is a flowchart of the print control according to the fourth embodiment.

FIGS. 15 and 16 are flowcharts of control performed when the MFP 101 receives print data from an external apparatus. In the fourth embodiment, the control is performed when print data is received based on the flowchart illustrated in FIG. 15 instead of FIG. 7. Furthermore, in the fourth embodiment, a determination is performed based on the flowchart illustrated in FIG. 16 instead of FIG. 13 of the third embodiment.

A process from step S1501 to step S1504 is the same as the process from step S701 to step S704 of the first embodiment, and therefore, a description thereof is omitted.

In step S1505, a CPU 111 performs a process of determining an obtained character string. In the determination in step S1505, it is determined whether a character sequentially selected from a top of the character string is a unique character used in a linguistic area where characters are horizontally written from right or vertically written from right similarly to FIG. 14. In the fourth embodiment, a check flag is set when the spool printing is performed in addition to the process of FIG. 14 in the third embodiment when a character is sequentially determined one by one. The process in step S1505 will be described in detail with reference to the flowchart of FIG. 16.

A process from step S1601 to step S1605 is the same as the process from step S1401 to step S1405 of the third embodiment, and therefore, a description thereof is omitted.

In step S1610, the CPU 111 sets an automatic change flag to TRUE as a job attribute of a print job. The automatic change flag is appropriately referred to when print control is performed on the spooled print data illustrated with reference to a flowchart of FIG. 17 described below.

On the other hand, in step S1605, the CPU 111 determines whether code data of the obtained one character is included in a character code space of the CJK unified ideographs, Hiragana, or Katakana. When the determination is affirmative, the process proceeds to step S1606. On the other hand, when the determination is negative, the determination process for each character is terminated and the determination is performed on a subsequent character in the character string.

In step S1606, the CPU 111 determines whether the print data is to be spooled. In a case where spooling of received print data is set to the MFP 101 as a setting of an operation performed when print data is received or a case where the spool printing is set as an attribute of the print data, it is determined that the print data is to be spooled and the process proceeds to step S1608. On the other hand, when the setting for spooling received print date is OFF and the spool printing is not set as an attribute of the print data, it is determined that the print data is not spooled and the process proceeds to step S1607.

In step S1607, as with step S1406, the CPU 111 proceeds to step S1604 when right opening is set in the MFP 101 as a default setting. On the other hand, when the setting based on the right opening is not performed, the determination process for one character is terminated and the determination process is performed on a subsequent character in the character string.

In step S1608, the CPU 111 sets a print check flag to TRUE as a job attribute of the print job. The print check flag is appropriately referred to when print control is performed on the spooled print data illustrated with reference to a flowchart of FIG. 17 described below.

Referring back to FIG. 15, a process in step S1506 and step S1507 is the same as the process in step S706 and step S707, and therefore, a description thereof is omitted. In step S1511, the CPU 111 determines whether the print data is to be spooled. In a case where spooling of received print data is set to the MFP 101 as a setting of an operation performed when print data is received or a case where the spool printing is set as an attribute of the print data, it is determined that the print data is to be spooled and the process proceeds to step S1512. On the other hand, when the setting for spooling the received print date is OFF and the spool printing is not set as an attribute of the print data, the process proceeds to step S1509. A process in step S1509 and step S1510 is the same as the print process and the post-processing in step S709 and step S710 of the first embodiment, and therefore, a description thereof is omitted.

In step S1512, the CPU 111 stores the print data in a data region for storing spooled print data based on the print job. By this process, the print data in which the print check flag and the automatic change flag which are set through the processes of FIG. 16 are set as attributes of the print data is spooled.

Spooling

Figure 17:
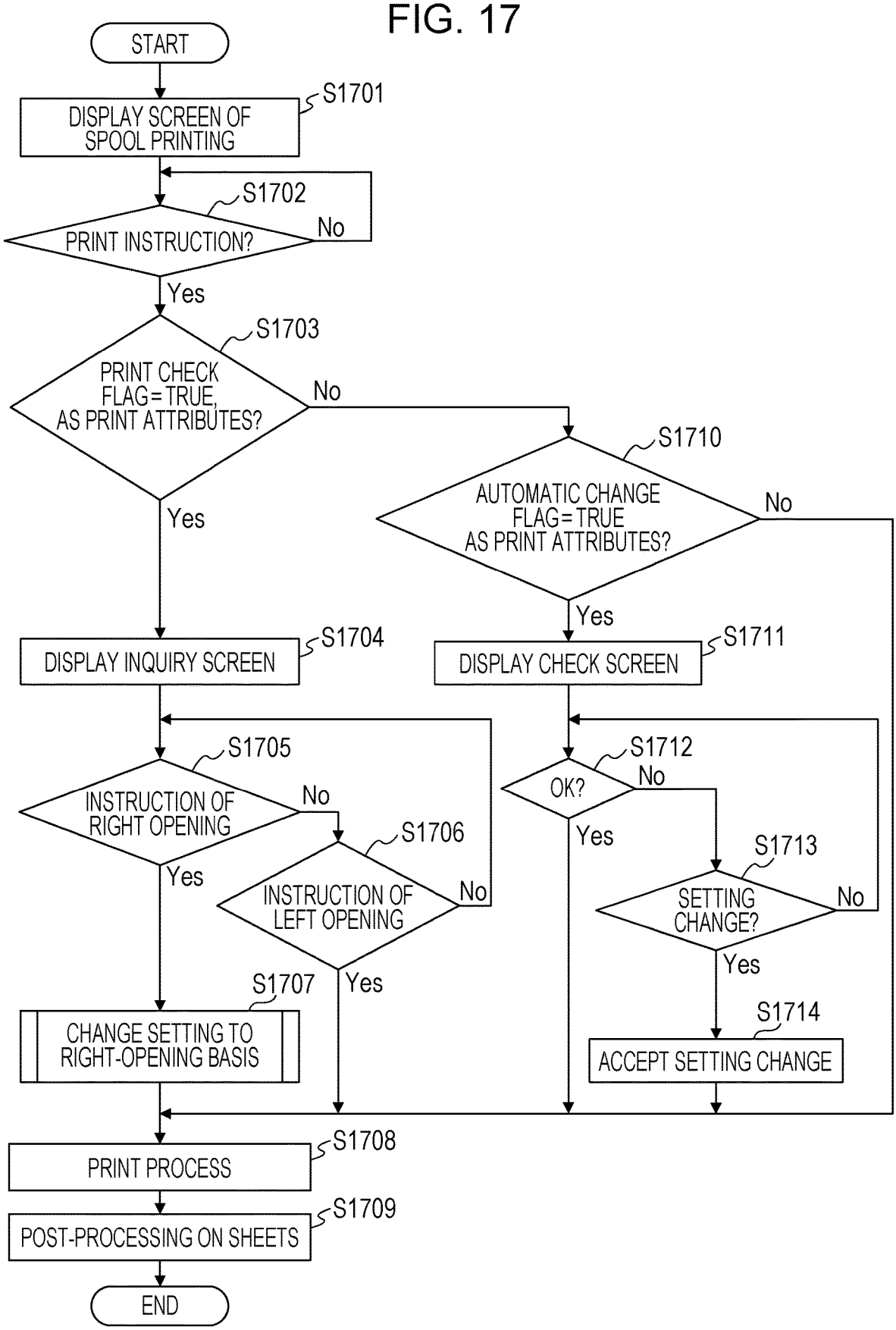
FIG. 17 is a flowchart of the print control according to the fourth embodiment.

Next, control performed in a case where print data spooled in the MFP 101 is selected and printed will be described. FIG. 17 is a flowchart of control performed when the user selects print data spooled in an MFP 101 for printing. Processes in the flowchart of FIG. 17 are executed when a function of the spool printing is selected from a main menu, not illustrated.

In step S1701, the CPU 111 displays a screen (not illustrated) associated with the spool printing in the operation unit 116. In step S1702, the CPU 111 determines whether an instruction for printing print data has been issued using the screen of the spool printing. The CPU 111 proceeds to step S1703 when receiving an instruction for starting printing in a state in which print data to be printed is selected, whereas the CPU 111 waits for a user instruction for selecting print data or a user instruction for printing when not receiving an instruction for starting printing.

In step S1703, the CPU 111 generates a print job based on the print data instructed to be printed. Furthermore, the CPU 111 determines whether the print check flag is TRUE with reference to the print attributes of the print job. When the determination is affirmative, the process proceeds to step S1704, and otherwise, the process proceeds to step S1710.

Figure 18A:
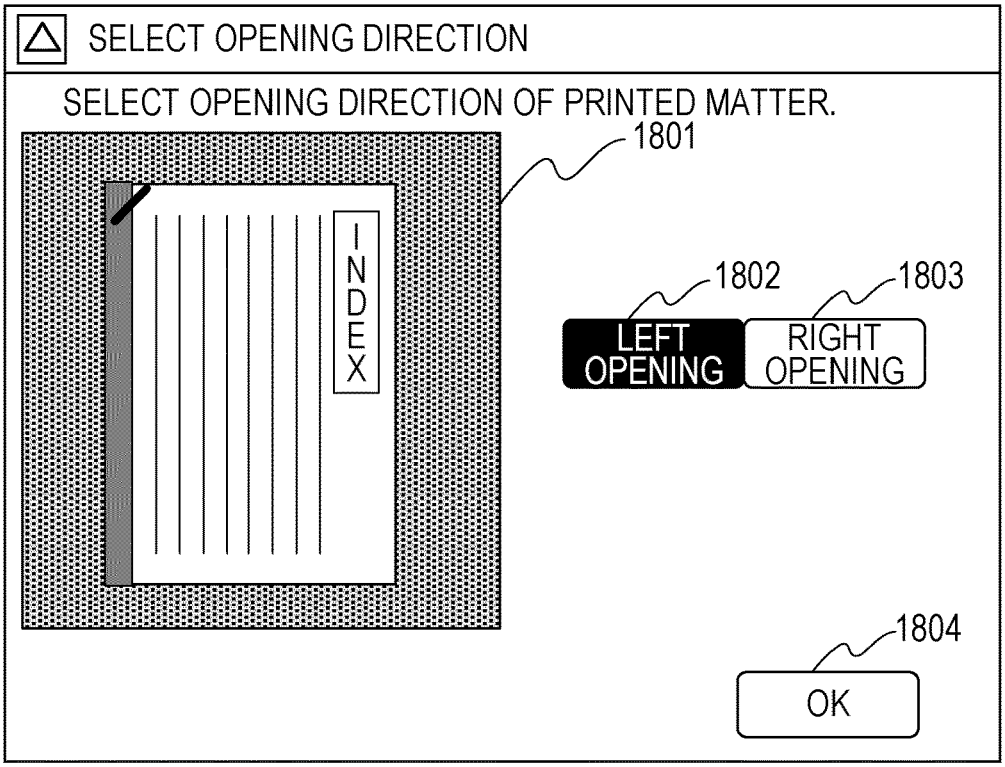
FIGS. 18A and 18B are diagrams illustrating screens displayed in a display unit 116 of an operation unit.
Figure 18B:
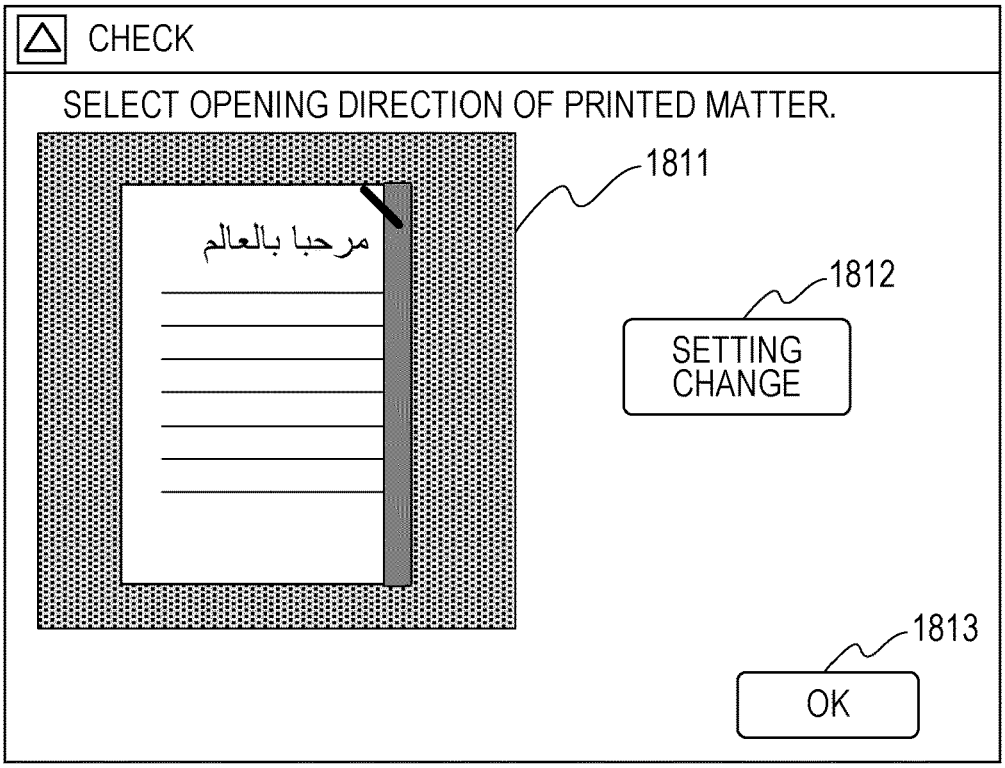

In step S1704, the CPU 111 displays an inquiry screen in the operation unit 116. FIGS. 18A and 18B are diagrams illustrating operation screens displayed in the operation unit 116. FIG. 18A is a diagram illustrating an inquiry screen.

The inquiry screen includes a preview region 1801 displayed based on the print data. The user may view a preview image displayed in the region 1801 so as to visually check content of the print data. Furthermore, a comment indicating a portion where the post-processing set in the print data is to be performed is assigned to the preview image. Accordingly, the user may visually check a type of the post-processing while viewing the preview image. Here, preview of the print data to be subjected to a stapling process on an upper left portion of a document vertically written from right is illustrated.

A left-opening key 1802 and a right-opening key 1803 are used when a setting of an opening direction is changed. The user selects the left-opening key 1802 or the right-opening key 1803 so as to change a direction of opening of the printed matter. When the user selects one of the keys so as to change the opening direction, the CPU 111 changes a position of a comment associated with the post-processing in the preview image in accordance with the change of the opening direction.

Furthermore, an OK key 1804 is used when the change performed through the inquiry screen is applied and printing is started.

The screen in FIG. 18A is displayed when the print check flag is set TRUE by the determination process in FIG. 16, that is, when the print data includes a character in the Japanese-speaking world or the Chinese-speaking world. Accordingly, the user who uses both of the horizontal writing and the vertical writing depending on a characteristic of a document may change a setting through the screen of FIG. 18A so that a printed matter of a format desired by the user is obtained.

Referring back to FIG. 17, the CPU 111 determines whether an instruction for performing printing in the right opening has been issued in step S1705. When an instruction for printing is issued in a state in which the right opening is selected, it is determined that an instruction for printing in right opening has been issued and the process proceeds to step S1707. On the other hand, when the instruction for printing has not been issued, the process proceeds to step S1706.

In step S1706, the CPU 111 determines whether an instruction for performing printing in the left opening has been issued. When an instruction for printing is issued in a state in which the left opening is selected, it is determined that an instruction for printing in left opening has been issued and the process proceeds to step S1708. On the other hand, when the instruction for printing has not been issued, the process returns to step S1705 and waits for an instruction issued by the user.

In step S1707, the CPU 111 changes the attributes of the print job to attributes based on the right opening similarly to step S707 of the first embodiment. In step S1708, the CPU 111 performs printing based on the print job similarly to step S709. In step S1709, as with step S710, the CPU 111 performs the post-processing where appropriate on the sheets printed in step S1708 in cooperation with the sheet processing unit 122 and terminates the process.

On the other hand, in step S1710, it is determined whether the automatic change flag is TRUE with reference to the attributes of the print job generated in step S1703. When the determination is affirmative, the process proceeds to step S1711, and otherwise, the process proceeds to step S1708.

In step S1711, the CPU 111 displays a check screen in the operation unit 116. FIG. 18B is a diagram illustrating the check screen.

The check screen includes a preview region 1811 displayed based on the print data. The user may view a preview image displayed in the region 1811 so as to visually check content of the print data and the setting of the post-processing. Here, preview of the print data to be subjected to a stapling process on an upper right portion of a document of Arabic horizontally written from right is illustrated. Accordingly, when a document horizontally written from right is to be printed, the user may visually check the change of the setting to the setting based on the right opening which is an output method suitable for the horizontal writing starting from right through the check screen.

Furthermore, a setting change key 1812 is used to change a setting on the print job. The user may display a setting screen, not illustrated, by selecting the setting change key 1812 so as to change a setting associated with the printing and a setting associated with the post-processing. An OK key 1813 is used when the printing is to be started.

Referring back to FIG. 17, the CPU 111 determines whether the OK key 1813 has been selected in step S1712. When the determination is affirmative, the process proceeds to step S1708 where the print process is performed. When the determination is negative, the process proceeds to step S1713. In step S1713, the CPU 111 determines whether an instruction for changing a setting has been received. When the determination is affirmative, the process proceeds to step S1714. When the determination is negative, the process returns to step S1712 where an instruction issued by the user is waited.

In step S1714, the CPU 111 receives an operation of changing a setting performed by the user. When an operation of completing the setting change is received in a setting change screen, not illustrated, the setting change is applied to the print job and the process proceeds to step S1708.

In this embodiment, a default setting (prescribed setting) used when a position of a post-processing is not clearly specified is used so that a printed matter based on the right stapling may be output when a character of the Japanese-speaking world or the Chinese-speaking world is included in print data. Furthermore, when the spool printing is to be performed, the print process is actually performed after causing the user to select a printed matter based on the right stapling or a printed matter based on the left stapling.

Accordingly, printing of a format desired by the user may be more reliably performed in an environment in which both of the horizontal writing and the vertical writing are used depending on a characteristic of a document in the Japanese-speaking world, the Chinese-speaking world, and the like.

Note that, although the case where the determination is made based on a character string of a job name or a file name is illustrated in the fourth embodiment, the present disclosure is not limited to this. As with the second embodiment, the determination may be made on a character string included in content of the print data.

Modifications

Although the printing apparatus including the printing unit is illustrated in the first to fourth embodiments, the present disclosure is not limited to this. For example, the present disclosure may be employed in a print controller connected to the printing apparatus. In this case, the print controller performs a process of receiving print data from the information processing apparatus and updating a setting of the received print data based on a character string included in the print data. Furthermore, the print controller transmits the updated print data to the printing apparatus and causes the printing apparatus to perform printing. Specifically, when print data is transmitted from a general print service, the print controller updates a print setting so that printing in a format desired by the user is performed and transmits the print setting to the printing apparatus. By this control, printing in a format desired by the user may be performed whenever possible.

Other Embodiments

The present disclosure may be realized by a process of supplying a program which realizes at least one of the functions of the foregoing embodiments to a system or an apparatus through a network or a storage medium and reading and executing the program using at least one processor included in a computer of the system or the apparatus. Alternatively, the present disclosure may be realized by a circuit (such as an application specific integrated circuit (ASIC)) which realizes at least one of the functions.

The present disclosure is not limited to the foregoing embodiments and various changes and modifications may be made without departing from the spirit and the scope of the present disclosure. Accordingly, the following claims are attached to disclose the scope of the present disclosure.

According to the present disclosure, post-processing may be performed on a printed matter in a more appropriate format based on a character code in print data.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A printing apparatus comprising:

a printing device;

at least one processor which acts as:

a reception unit configured to receive print data from an external apparatus;

a printing control unit configured to cause the printing device to perform printing on sheets based on the print data received by the reception unit;

a post-processing controller configured to control a post-processing apparatus connected to the printing apparatus to execute post-processing on the sheets printed by the printing device; and a controller configured to control at least one of the printing control unit and the post-processing controller so that the post-processing is executed on a right end of the sheets printed based on the print data in a case where a predetermined character code is included in the print data and an instruction for executing the post-processing on a left end of the sheets printed based on the print data is included in the print data, and control at least one of the printing control unit and the post-processing controller so that the post-processing is executed based on a position of the post-processing set in the print data when the predetermined character code is not included in the print data and an instruction for executing the post-processing on the sheets printed based on the print data is included in the print data.

2. The printing apparatus according to claim 1, the processor further acts as:

a determination unit configured to determine whether the predetermined character code is included in the print data received by the reception unit, wherein the print data includes a name of a data file which is a source of generation of the print data, and wherein the determination unit determines that the predetermined character code is included in the print data when a character string indicating the name included in the print data includes a character indicated by the predetermined character code.

3. The printing apparatus according to claim 2, wherein the print data further includes a name of an application associated with the generation of the print data, and wherein the determination unit determines that the predetermined character code is included in the print data when a character string indicating the name included in the print data includes a character indicated by the predetermined character code.

4. The printing apparatus according to claim 2, wherein the determination unit further obtains a character string of content to be printed included in the print data and determines that the predetermined character code is included in the print data when the character string includes a character represented by the predetermined character code.

5. The printing apparatus according to claim 1, wherein the predetermined character code is included in a character code space corresponding to a character set used in documents horizontally written from right to left.

6. The printing apparatus according to claim 1, wherein the predetermined character code is included in a character space corresponding to at least a character set of Arabian, a character set of Hebraic, or a character set of Syrian.

7. The printing apparatus according to claim 1, further comprising:

a storage device that store an execution position of the post-processing when an instruction for specifying a position of the post-processing is not included in the print data, wherein the predetermined character code includes a character code in a first character code space corresponding to a character set used in documents horizontally written from right to left and a character code in a second character code space corresponding to a character set used in documents vertically written from top to bottom, and wherein the controller performs control such that the post-processing is performed on a right end of the sheets printed based on the print data even when an instruction for executing the post-processing on a left end of the sheets printed based on the print data is included in the print data in a case where the predetermined character code is included in the print data and the predetermined character code is included in a first character code space, and controls at least one of the printing unit and the post-processing controller so that the post-processing is performed in a position corresponding to the execution position stored in the storage device instead of the control in a case where the predetermined character code is included in a second character code space even when the predetermined character code is included in the print data.

8. The printing apparatus according to claim 1, the processor further acts as:

an inquiry unit configured to transmit an inquiry to a user whether the post-processing is performed on a right end of the sheets printed based on the print data or the post-processing is performed in a position based on an instruction for specifying a position of the post-processing which is included in the print data in a case where the predetermined character code is included in the print data and an instruction for executing the post-processing is included in the print data.

9. The printing apparatus according to claim 1, further comprising a display device;

wherein the processor further acts as:

display control unit configured to display preview of a format of a printed matter on the display device in a case where the predetermined character code is included in the print data and an instruction for executing the post-processing is included in the print data.

10. The printing apparatus according to claim 1, wherein an instruction for executing a stapling process of stapling the sheets printed based on the print data and an instruction for executing a punching process of forming a punching hole on the printed sheets are set in the print data as settings of the post-processing.

11. The printing apparatus according to claim 1, wherein the processor further acts as:

a determination unit configured to determine whether the print data received by the reception unit has been generated by a predetermined print service, wherein the controller executes the control when the determination unit determines that the print data has been generated by the predetermined print service and controls at least one of the printing unit and the post-processing controller so that the post-processing is performed on a left end of the sheets printed based on the print data instead of the control even when the predetermined character code is included in the print data and an instruction for executing the post-processing on the left end of the sheets printed based on the print data is included in the print data in a case where the determination unit determines that the print data has not been generated by the predetermined print service.

12. A method for controlling a printing apparatus, comprising:

receiving print data from an external apparatus;

performing printing on sheets based on the received print data;

controlling a post-processing apparatus connected to the printing apparatus and executing post-processing on the printed sheets;

controlling at least one of the printing unit and the post-processing controller so that the post-processing is executed on a right end of the sheets printed based on the print data in a case where a predetermined character code is included in the print data and an instruction for executing the post-processing on a left end of the sheets printed based on the print data is included in the print data, and controlling at least one of the printing and the post-processing control so that the post-processing is executed based on a position of the post-processing set in the print data when the predetermined character code is not included in the print data and an instruction for executing the post-processing on sheets printed based on the print data is included in the print data.

13. A non-transitory computer-readable storage medium storing a program for causing a computer to execute a method of controlling a printing apparatus, the method comprising:

receiving print data supplied from an external apparatus;

performing printing on sheets based on the received print data;

controlling a post-processing apparatus connected to the printing apparatus and executing post-processing on the printed sheets;

controlling at least one of the printing unit and the post-processing controller so that the post-processing is executed on a right end of the sheets printed based on the print data in a case where a predetermined character code is included in the print data and an instruction for executing the post-processing on a left end of the sheets printed based on the print data is included in the print data, and controlling at least one of the printing and the post-processing control so that the post-processing is executed based on a position of the post-processing set in the print data when the predetermined character code is not included in the print data and an instruction for executing the post-processing on sheets printed based on the print data is included in the print data.

* * * * *